US010327067B2

(12) United States Patent
Chang et al.

(10) Patent No.: US 10,327,067 B2
(45) Date of Patent: Jun. 18, 2019

(54) THREE-DIMENSIONAL SOUND REPRODUCTION METHOD AND DEVICE

(71) Applicant: SAMSUNG ELECTRONICS CO., LTD., Suwon-si (KR)

(72) Inventors: Ji-ho Chang, Suwon-si (KR); Dong-hyun Jung, Seoul (KR); Dong-kyu Park, Hwaseong-si (KR); Hae-kwang Park, Suwon-si (KR); Yoon-jae Lee, Seoul (KR); Dong-hyun Lim, Seoul (KR); Jae-youn Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/569,576

(22) PCT Filed: Mar. 7, 2016

(86) PCT No.: PCT/KR2016/002253
§ 371 (c)(1),
(2) Date: Oct. 26, 2017

(87) PCT Pub. No.: WO2016/182184
PCT Pub. Date: Nov. 17, 2016

(65) Prior Publication Data

US 2018/0317003 A1 Nov. 1, 2018

(30) Foreign Application Priority Data

May 8, 2015 (KR) ..... 10-2015-0064898

(51) Int. Cl.
*H04R 1/34* (2006.01)
*H04R 5/02* (2006.01)
(Continued)

(52) U.S. Cl.
CPC ..... *H04R 1/345* (2013.01); *H04R 1/403* (2013.01); *H04R 5/02* (2013.01); *H04S 3/002* (2013.01);
(Continued)

(58) Field of Classification Search
CPC . H04R 1/345; H04S 7/30; H04S 3/008; H04S 7/301
(Continued)

(56) References Cited

U.S. PATENT DOCUMENTS 3,582,553 A 6/1971 Bose et al.
3,627,948 A 12/1971 Nichols
(Continued)

FOREIGN PATENT DOCUMENTS

KR 1019990088677 A 12/1999
KR 1020120004916 A 1/2012
(Continued)

OTHER PUBLICATIONS

International Search Report and Written Opinion (PCT/ISA/210 and PCT/ISA/237), dated Jun. 29, 2016 by International Searching Authority in International Application No. PCT/KR2016/002253.
(Continued)

*Primary Examiner* — Gerald Gauthier
(74) *Attorney, Agent, or Firm* — Sughrue Mion, PLLC

(57) ABSTRACT

According to an aspect of an embodiment, a stereophonic sound reproduction apparatus includes: an input unit for receiving an acoustic signal; a control unit for acquiring an output acoustic signal for generating a virtual sound source for the received acoustic signal; and an output unit for outputting the acquired output acoustic signal by using a front speaker and a side speaker, wherein the control unit generates an attenuation signal that is a signal for attenuating or cancelling an inflow acoustic signal to be directly trans-
(Continued)

ferred to an audience in the output acoustic signal output from the side speaker, and the generated output acoustic signal includes the attenuation signal.

15 Claims, 15 Drawing Sheets

(51) Int. Cl.

| | |
|---|---|
| ***H04S 3/00*** | (2006.01) |
| ***H04S 5/00*** | (2006.01) |
| ***H04R 1/40*** | (2006.01) |
| ***H04S 7/00*** | (2006.01) |
| *H04R 1/30* | (2006.01) |
| *H04R 5/04* | (2006.01) |

(52) U.S. Cl.
CPC ..... *H04S 5/005* (2013.01); *H04S 7/302* (2013.01); *H04R 1/30* (2013.01); *H04R 5/04* (2013.01); *H04R 2201/025* (2013.01); *H04R 2430/03* (2013.01); *H04S 2420/01* (2013.01); *H04S 2420/07* (2013.01)

(58) Field of Classification Search
USPC ..... 181/144; 340/904; 381/1, 17, 18, 20, 381/61, 71.4, 71.8, 71.11, 92, 116, 150, 381/191, 300, 302, 303, 307, 310, 19, 28, 381/99, 304, 309; 84/723; 348/51
See application file for complete search history.

(56) References Cited

U.S. PATENT DOCUMENTS 3,727,004 A 4/1973 Bose
4,058,675 A 11/1977 Kobayashi et al.
4,133,975 A 1/1979 Barker, III
4,256,922 A 3/1981 Görike
5,210,802 A * 5/1993 Aylward ..... H04R 1/323 381/387
5,412,732 A * 5/1995 Kanishi ..... H04S 5/02 381/18
5,809,150 A 9/1998 Eberbach
5,809,153 A 9/1998 Aylward et al.
5,898,137 A * 4/1999 Saito ..... H04N 5/642 181/144
6,445,804 B1 * 9/2002 Hirayanagi ..... H04R 3/00 381/117
6,577,736 B1 * 6/2003 Clemow ..... H04R 5/02 381/17
6,625,289 B1 9/2003 Oliemuller
6,904,152 B1 * 6/2005 Moorer ..... H04S 5/005 381/17
7,138,576 B2 * 11/2006 Metcalf ..... G10H 1/0091 84/723
7,236,606 B2 6/2007 Werner
7,278,513 B2 10/2007 Brawley, Jr.
7,362,874 B2 4/2008 Lee et al.
7,536,021 B2 * 5/2009 Dickins ..... H04S 3/004 381/310
8,031,883 B2 * 10/2011 Bai ..... H04S 1/002 381/17
8,121,336 B2 2/2012 Hutt et al.
8,139,774 B2 3/2012 Berardi et al.
8,150,068 B2 4/2012 Konagai et al.
8,254,583 B2 8/2012 Kim
8,345,883 B2 1/2013 Takumai et al.
8,351,630 B2 1/2013 Ickler et al.
8,369,533 B2 2/2013 Konagai et al.
8,442,244 B1 * 5/2013 Long, Jr. ..... H04R 5/027 381/26
8,520,858 B2 * 8/2013 Metcalf ..... H04R 5/00 381/28
8,553,894 B2 10/2013 Berardi et al.
9,749,769 B2 * 8/2017 Giron ..... H04S 7/30
2001/0040968 A1 * 11/2001 Mukojima ..... H04S 1/002 381/17
2002/0031231 A1 * 3/2002 Oinoue ..... H04S 1/002 381/1
2003/0138106 A1 * 7/2003 Dabringhaus ..... H04R 5/02 381/17
2003/0206639 A1 * 11/2003 Griesinger ..... H04S 7/302 381/20
2004/0062401 A1 * 4/2004 Davis ..... H04S 3/002 381/1
2004/0190727 A1 * 9/2004 Bacon ..... H04S 3/002 381/61
2004/0247134 A1 * 12/2004 Miller, III ..... H04S 3/002 381/19
2006/0269071 A1 * 11/2006 Nakano ..... H04S 3/002 381/17
2006/0291665 A1 * 12/2006 Tsuiki ..... H04R 1/026 381/17
2007/0110249 A1 * 5/2007 Kimura ..... H04S 1/002 381/17
2007/0127746 A1 * 6/2007 Matsuzawa ..... B06B 1/0292 381/191
2007/0154035 A1 * 7/2007 Fukui ..... B06B 1/0292 381/116
2007/0274541 A1 * 11/2007 Uetake ..... G10K 15/02 381/150
2007/0291967 A1 * 12/2007 Pedersen ..... H04S 1/002 381/309
2009/0057052 A1 3/2009 Delgado, Jr.
2009/0097669 A1 * 4/2009 Kamiya ..... G10K 11/178 381/71.4
2009/0097679 A1 * 4/2009 Maeda ..... H04S 3/008 381/302
2009/0103753 A1 * 4/2009 Hsu ..... H04R 1/403 381/307
2009/0110219 A1 * 4/2009 Kushida ..... H04R 3/12 381/303
2009/0154713 A1 * 6/2009 Kamiya ..... H04S 7/302 381/1
2009/0238372 A1 * 9/2009 Hsu ..... H04R 1/323 381/61
2009/0316939 A1 * 12/2009 Matsumoto ..... H04R 5/04 381/302
2010/0061575 A1 * 3/2010 Fletcher ..... H04R 5/02 381/300
2010/0124337 A1 * 5/2010 Wertz ..... G10K 11/1786 381/71.11
2010/0296678 A1 * 11/2010 Kuhn-Rahloff ..... H04S 7/30 381/303
2011/0249819 A1 * 10/2011 Davis ..... H04S 5/005 381/17
2012/0008789 A1 1/2012 Kim et al.
2012/0105603 A1 * 5/2012 Liu ..... H04S 7/302 348/51
2012/0114137 A1 * 5/2012 Tsurumi ..... H04S 7/303 381/92
2012/0140960 A1 * 6/2012 Jang ..... H04R 1/323 381/307
2012/0155650 A1 * 6/2012 Horbach ..... H04R 5/02 381/17
2012/0224701 A1 * 9/2012 Sakai ..... H04S 7/301 381/17
2012/0314872 A1 * 12/2012 Tan ..... H04N 5/60 381/17
2013/0121515 A1 * 5/2013 Hooley ..... H04R 1/403 381/307
2013/0156198 A1 * 6/2013 Kim ..... H04R 1/323 381/17
2013/0182865 A1 * 7/2013 Paul ..... G10K 11/178 381/71.8
2013/0194107 A1 * 8/2013 Nagata ..... B60Q 9/00 340/904
2013/0216070 A1 * 8/2013 Keiler ..... G10L 19/008 381/300

(56) References Cited

U.S. PATENT DOCUMENTS

2013/0216071 A1* 8/2013 Maher ..... H04R 3/04 381/303
2013/0279723 A1* 10/2013 Hooley ..... H04R 1/403 381/304
2013/0315402 A1* 11/2013 Visser ..... G10L 19/00 381/18
2014/0064526 A1* 3/2014 Otto ..... H04S 5/00 381/300
2014/0133660 A1* 5/2014 Jax ..... G10L 21/00 381/17
2014/0219458 A1 8/2014 Tanaka et al.
2015/0023505 A1* 1/2015 Morrow ..... H04R 3/12 381/17
2015/0131824 A1* 5/2015 Nguyen ..... H04S 7/307 381/300
2016/0080884 A1* 3/2016 Song ..... G10L 19/008 381/17
2016/0112819 A1* 4/2016 Mehnert ..... H04S 5/005 381/303
2016/0112820 A1* 4/2016 Yoo ..... H04S 7/302 381/17
2016/0330560 A1* 11/2016 Chon ..... H04S 5/005
2017/0086005 A1* 3/2017 Oh ..... H04R 27/00
2018/0317003 A1* 11/2018 Chang ..... H04R 5/02

FOREIGN PATENT DOCUMENTS

KR 1020120103046 A 9/2012
KR 1020130109615 A 10/2013
KR 101368859 B1 2/2014
WO 0123104 A2 4/2001
WO 2013012582 A1 1/2013

OTHER PUBLICATIONS

Jungil Seo et al., "Status of 3D Audio Technology Development for the difference of Listening Environments", The Korean Society of Broad Engineers, Broadcasting and Media Magazine, Mar. 2008, (pp. 82-96)

* cited by examiner

THREE-DIMENSIONAL SOUND REPRODUCTION METHOD AND DEVICE

TECHNICAL FIELD

The present invention relates to a method and apparatus for reproducing a stereophonic sound and, more specifically, to a method and apparatus for generating a virtual sound source at a predetermined location by using a reflected sound of a speaker located at a side surface.

BACKGROUND ART

Along with developments in image and sound processing techniques, pieces of content having high image quality and high sound quality have been produced. An audience requesting content having high image quality and high sound quality desires a realistic image and sound, and accordingly, research into stereoscopic imaging and stereophonic sound has been actively conducted.

However, recently, a speaker having a plurality of speaker units integrated in one enclosure, such as a miniaturized wireless speaker and sound bar, has been widely used, but with respect to this speaker, it is difficult to provide a wide sound stage intended in a stereo system since a distance between a left speaker and a right speaker is relatively short.

Therefore, when a speaker is miniaturized, an audience may not feel a sense of spaciousness or a three-dimensional (3D) effect.

DETAILED DESCRIPTION OF THE INVENTION

Technical Problem

Provided are a stereophonic sound reproduction apparatus and method for providing a three-dimensional (3D) effect and a sense of space to an audience.

In addition, provided is a computer-readable recording medium having recorded thereon a program for executing, in a computer, the method. The technical problems according to the present embodiments are not limited to the technical problems described above, and other technical problems may be derived from the embodiments below.

BEST MODE

Figure 1:
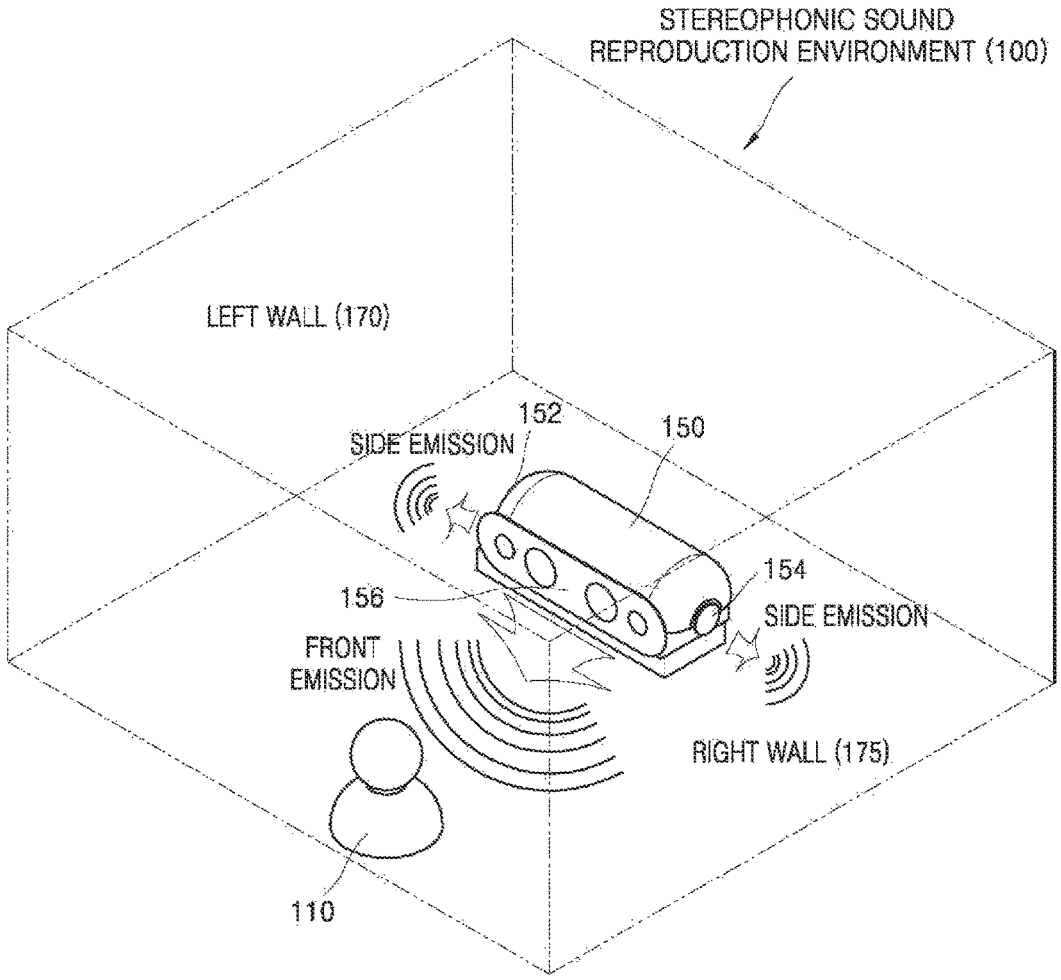
FIG. 1 illustrates a stereophonic sound reproduction environment of an audience, according to an embodiment.

According to an embodiment, a stereophonic sound reproduction apparatus includes: an input unit configured to receive an acoustic signal; a control unit configured to acquire an output acoustic signal for generating a virtual sound source for the received acoustic signal; and an output unit configured to output the acquired output acoustic signal by using a front speaker and a side speaker, wherein the control unit is further configured to generate an attenuation signal that is a signal for attenuating or cancelling an inflow acoustic signal to be directly transferred to an audience in the output acoustic signal output from the side speaker, and the output acoustic signal output from the front speaker includes the attenuation signal.

The side speaker may include a left speaker and a right speaker, the control unit may be further configured to generate at least one of a first attenuation signal for attenuating or cancelling, at a location of the audience, a left inflow acoustic signal to be directly transferred to the audience without being reflected from a left wall in an output acoustic signal output from the left speaker and a second attenuation signal for attenuating or cancelling, at the location of the audience, a right inflow acoustic signal to be directly transferred to the audience without being reflected from a right wall in an output acoustic signal output from the right speaker, and the front speaker may include at least one speaker configured to output at least one attenuation signal of the first attenuation signal and the second attenuation signal.

The control unit may be further configured to predict the left inflow acoustic signal and the right inflow acoustic signal arriving at the location of the audience, based on an acoustic transfer function using path information between a location of the side speaker and the location of the audience and generate the attenuation signal based on the predicted left inflow acoustic signal and right inflow acoustic signal, and on an acoustic transfer function using path information between a location of the speaker outputting the attenuation signal and the location of the audience.

The virtual sound source may include a first virtual sound source for a left channel signal of the received acoustic signal and a second virtual sound source for a right channel signal of the received acoustic signal, and the control unit may be further configured to acquire the output acoustic signal by controlling at least one of a magnitude, a time delay, and an output direction of the received acoustic signal, to generate the first virtual sound source and the second virtual sound source based on an acoustic signal generated when the output acoustic signal output from the side speaker is reflected from a wall and on the output acoustic signal output from the front speaker.

The side speaker may include a left speaker located to the left of the stereophonic sound reproduction apparatus and a right speaker located to the right thereof, and the control unit may be further configured to control at least one of a magnitude, a time delay, and an output direction of the received acoustic signal, to generate the first virtual sound source and the second virtual sound source based on an acoustic signal generated when the output acoustic signal output from the left speaker is reflected from the left wall, on an acoustic signal generated when the output acoustic signal output from the right speaker is reflected from the right wall, and on the output acoustic signal output from the front speaker.

The control unit may be further configured to control at least one of a magnitude, a time delay, and an output direction of the left channel signal of the received acoustic signal to generate the first virtual sound source at a first location by using an acoustic signal generated when a left channel signal of the output acoustic signal output from the left speaker is reflected from the left wall, an acoustic signal generated when a left channel signal of the output acoustic signal output from the right speaker is reflected from the right wall, and a left channel signal of the output acoustic signal output from the front speaker and control at least one of a magnitude, a time delay, and an output direction of the right channel signal of the received acoustic signal to generate the second virtual sound source at a second location by using an acoustic signal generated when a right channel signal of the output acoustic signal output from the left speaker is reflected from the left wall, an acoustic signal generated when a right channel signal of the output acoustic signal output from the right speaker is reflected from the right wall, and a right channel signal of the output acoustic signal output from the front speaker, and the first location and the second location may be respectively located to the left and the right of the audience based on a direction in which the audience looks at the stereophonic sound reproduction apparatus.

The control unit may be further configured to determine the first location and the second location based on spatial characteristics of a sound image provided by the received acoustic signal and control at least one of magnitude values of the left channel signal and the right channel signal of the received acoustic signal based on the determined first location and second location.

The control unit may be further configured to determine a distance from the side speaker to the wall and an angle between the side speaker and the wall and control a direction in which the side speaker outputs an acoustic signal as a horizontal or vertical direction with respect to the ground based on the determined distance and angle.

The side speaker may have a horn shape.

The side speaker may be included in an enclosure of a woofer inside the stereophonic sound reproduction apparatus.

The control unit may include a panning unit and an attenuation signal generation unit, the panning unit may be configured to control at least one of a magnitude, a time delay, and an output direction of the received acoustic signal to generate the virtual sound source based on the acoustic signal generated when the output acoustic signal output from the side speaker is reflected from the wall and on the output acoustic signal output from the front speaker, and the attenuation signal generation unit may be configured to generate the attenuation signal that is a signal for attenuating or cancelling the inflow acoustic signal to be directly transferred to the audience in the output acoustic signal output from the side speaker.

According to an embodiment, a stereophonic sound reproduction method includes: receiving an acoustic signal; acquiring an output acoustic signal for generating a virtual sound source for the received acoustic signal; and outputting the generated output acoustic signal by using a front speaker and a side speaker, wherein the acquiring of the output acoustic signal includes generating an attenuation signal that is a signal for attenuating or cancelling an inflow acoustic signal to be directly transferred to an audience in the output acoustic signal output from the side speaker, and the output acoustic signal output from the front speaker includes the attenuation signal.

The side speaker may include a left speaker and a right speaker, the generating of the output acoustic signal may include generating at least one of a first attenuation signal for attenuating or cancelling, at a location of the audience, a left inflow acoustic signal to be directly transferred to the audience without being reflected from a left wall in an output acoustic signal output from the left speaker and a second attenuation signal for attenuating or cancelling, at the location of the audience, a right inflow acoustic signal to be directly transferred to the audience without being reflected from a right wall in an output acoustic signal output from the right speaker, and the front speaker may include at least one speaker for outputting at least one attenuation signal of the first attenuation signal and the second attenuation signal.

The virtual sound source may include a first virtual sound source for a left channel signal of the received acoustic signal and a second virtual sound source for a right channel signal of the received acoustic signal, the generating of the output acoustic signal may include controlling at least one of a magnitude, a time delay, and an output direction of the received acoustic signal, to generate the first virtual sound source and the second virtual sound source based on an acoustic signal generated when the output acoustic signal output from the side speaker is reflected from a wall and on the output acoustic signal output from the front speaker, and the generated output acoustic signal may include the controlled acoustic signal.

A computer-readable recording medium has recorded thereon a program for executing, in a computer, the stereophonic sound reproduction method.

MODE OF THE INVENTION

Hereinafter, exemplary embodiments of the present invention will be described in detail with reference to the accompanying drawings. Advantages and features, and a method for achieving them will be clear with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those of ordinary skill in the art, and the invention is only defined by the scope of the claims. The terms used in this specification are those general terms currently widely used in the art, but the terms may vary according to the intention of those of ordinary skill in the art, precedents, or new technology in the art. Also, specified terms may be selected by the applicant, and in this case, the detailed meaning thereof will be described in the detailed description. Thus, the terms used in the specification should be understood not as simple names but based on the meaning of the terms and the overall description. Hereinafter, embodiments will be described in detail with reference to the drawings. The embodiments disclosed in the specification and the configurations shown in the drawings are merely exemplary embodiments of the present invention and do not entirely represent the technical spirit of the present invention, and thus it should be understood that various equivalents and modifications for replacing the exemplary embodiments may exist at the filing date of the present application.

In addition, the term ' . . . unit' or " . . . module" used in the specification indicates a hardware component or circuit, such as a Field Programmable Gate Array (FPGA) or an Application-Specific Integrated Circuit (ASIC).

FIG. 1 illustrates a stereophonic sound reproduction environment of an audience, according to an embodiment.

A stereophonic sound reproduction environment 100 is an example of an environment in which an audience 110 listens to a sound through a stereophonic sound reproduction apparatus 150. The stereophonic sound reproduction environment 100 is an environment for reproducing acoustic content alone or in combination with other content such as a video and may indicate a randomly open, partially closed, or completely closed region such as a room embodied by a house, a cinema, a theater, a hall, a studio, a game console, or the like.

According to an embodiment, the stereophonic sound reproduction environment 100 may include a left wall 170 and a right wall 175 existing around the audience 110. The left wall 170 is a wall located to the left based on a direction in which the audience 110 looks at the stereophonic sound reproduction apparatus 150, and the right wall 175 is a wall located to the right based on the direction in which the audience 110 looks at the stereophonic sound reproduction apparatus 150. According to an embodiment, each of the left wall 170 and the right wall 175 may be located in parallel to the stereophonic sound reproduction apparatus 150 or obliquely with respect to the stereophonic sound reproduction apparatus 150. Although FIG. 1 shows that the left wall 170 and the right wall 175 are walls, the left wall 170 and the right wall 175 may include any type of object or organism capable of reflecting an acoustic signal in the stereophonic sound reproduction environment 100.

The audience 110 may listen to a sound through the stereophonic sound reproduction apparatus 150. According to an embodiment, the stereophonic sound reproduction apparatus 150 may include miniaturized wired or wireless speakers such as a sound bar, a sound ball, and a Bluetooth speaker. According to an embodiment, the stereophonic sound reproduction apparatus 150 may receive an acoustic signal from an external device such as a television, a computer, a smartphone, or a tablet personal computer (PC) through a communication path and reproduce the received acoustic signal.

According to an embodiment, in the inside of the stereophonic sound reproduction apparatus 150, a side speaker (may include a left speaker 152 located to the left and a right speaker 154 located to the right) and a front speaker 156 located at the front in the direction of the audience 110 may exist. According to an embodiment, the front speaker 156 may include a tweeter speaker for outputting (or emitting) an acoustic signal of a high frequency band of a received acoustic signal and a mid-range speaker for outputting an acoustic signal of a mid-frequency band thereof. According to an embodiment, the tweeter speaker in the front speaker 156 may include a left tweeter speaker and a right tweeter speaker. According to an embodiment, the left speaker 152 and the right speaker 154 may include only a tweeter speaker or both a mid-range speaker and a tweeter speaker.

According to an embodiment, an output acoustic signal output from the left speaker 152 may be transferred to the audience 110 by being reflected after colliding with the left wall 170. According to an embodiment, an output acoustic signal output from the right speaker 154 may be transferred to the audience 110 by being reflected after colliding with the right wall 175.

According to an embodiment, a portion of an output acoustic signal output from the left speaker 152 may be directly transferred to the audience 110 without being reflected after colliding with the left wall 170 and is referred to as a left inflow acoustic signal. According to an embodiment, a portion of an output acoustic signal output from the right speaker 154 may be directly transferred to the audience 110 without being reflected after colliding with the right wall 175 and is referred to as a right inflow acoustic signal. According to an embodiment, as output acoustic signals output from the left speaker 152 and the right speaker 154 are in a high frequency band, directivity of the output acoustic signals may increase, and thus a left inflow acoustic signal and a right inflow acoustic signal may have a smaller magnitude than a magnitude of the total acoustic signals output from the left speaker 152 and the right speaker 154. The left speaker 152 and the right speaker 154 may have a horn shape to improve directivity.

According to an embodiment, an output acoustic signal output from the front speaker 156 may be directly transferred to the audience 110 without reflection.

According to an embodiment, the stereophonic sound reproduction environment 100 may include a sweet spot (not shown) that is a spatial range in which an optimal stereophonic sound may be enjoyed. The stereophonic sound reproduction environment 100 may set locations of virtual ears of the audience 110 such that an optimal stereophonic sound is outputted at the sweet spot near the ears. Hereinafter, it is assumed that the stereophonic sound reproduction apparatus 150 knows the location of the sweet spot.

Hereinafter, the side speaker may include the left speaker 152 and/or the right speaker 154, and the wall may include the left wall 170 and/or the right wall 175. In addition, an output acoustic signal may include a left channel signal and a right channel signal.

Hereinafter, an operation of the stereophonic sound reproduction apparatus 150 will be described in detail with reference to FIGS. 2A through 9 below.

Figure 2A:
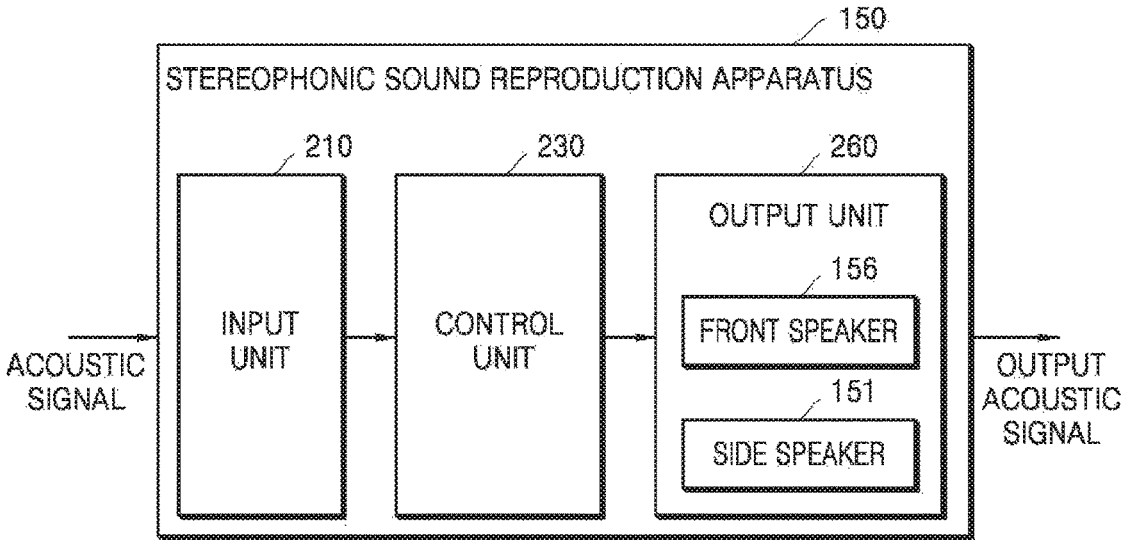
FIG. 2A is a block diagram of a stereophonic sound reproduction apparatus according to an embodiment.

FIG. 2A is a block diagram of a stereophonic sound reproduction apparatus according to an embodiment.

According to an embodiment, the stereophonic sound reproduction apparatus 150 may include an input unit 210, a control unit 230, and an output unit 260.

The input unit 210 may receive an acoustic signal (that is, an audio signal) from a device such as a digital versatile disc (DVD) player, a Blu-ray disc (BD) player, or an MP3 player. According to an embodiment, the input unit 210 may receive an acoustic signal input through various communication paths described above. For example, the input unit 210 may receive, through a communication path, an acoustic signal from an external device such as a television, a computer, a cellular phone, or a tablet PC.

The communication path may indicate various networks and network topologies. For example, the communication path may include wireless communication, wired communication, optics, ultrasound waves, or a combination thereof. Satellite communication, mobile communication, Bluetooth, infrared data association standard (IrDA), wireless fidelity (WiFi), and worldwide interoperability for microwave access (WiMAX) are examples of wireless communication which may be included in the communication path. Ethernet, digital subscriber line (DSL), fiber to the home (FTTH), and plain old telephone service (POTS) are examples of wired communication which may be included in the communication path. In addition, the communication path may include personal area network (PAN), local area network (LAN), metropolitan area network (MAN), wide area network (WAN), or a combination thereof.

The received acoustic signal may be a multi-channel acoustic signal such as a stereo signal (two channels), a 5.1-channel signal, a 7.1-channel signal, a 10.2-channel signal, or a 22.2-channel signal. The stereophonic sound reproduction apparatus 150 may control and output the received multi-channel acoustic signal so as to generate a virtual sound source with a different location. Hereinafter, for convenience of description, it is assumed that the virtual sound source is generated by using a left channel signal and a right channel signal of the received acoustic signal. According to an embodiment, the input unit 210 may convert the multi-channel acoustic signal into a stereo signal by down-mixing the multi-channel acoustic signal.

The control unit 230 may acquire an output acoustic signal for generating the virtual sound source for the received acoustic signal. The output acoustic signal may include acoustic signals to be output from a side speaker 151 and the front speaker 156.

According to an embodiment, the virtual sound source may include a first virtual sound source existing to the left and a second virtual sound source existing to the right, based on a direction in which the audience 110 looks at the stereophonic sound reproduction apparatus 150. According to an embodiment, the control unit 230 may acquire, from the received acoustic signal, an output acoustic signal for generating the first virtual sound source for the left channel signal of the received acoustic signal and generating the second virtual sound source for the right channel signal of the received acoustic signal. According to an embodiment, the control unit 230 may use acoustic signals reflected from the left wall 170 and the right wall 175 to generate the first virtual sound source and the second virtual sound source.

According to an embodiment, the control unit 230 may control at least one of a magnitude, a time delay, and an output direction of the received acoustic signal to generate the virtual sound source based on an acoustic signal generated when an output acoustic signal output from the side speaker 151 is reflected from a wall and on an output acoustic signal output from the front speaker. The acoustic signal of which at least one of the magnitude, the time delay, and the output direction has been controlled may be acquired as an output acoustic signal, and the acquired output acoustic signal may be output through the left speaker 152, the right speaker 154, and the front speaker 156 in the output unit 260. According to an embodiment, the control unit 230 may determine a magnitude, a time delay, and an output direction of an output acoustic signal to be output from each speaker (152, 154, or 156) by controlling at least one of the magnitude, the time delay, and the output direction of the received acoustic signal. According to an embodiment, the control unit 230 may independently control the left channel signal and the right channel signal of the received acoustic signal and independently determine a left channel signal and a right channel signal of the output acoustic signal to be output from each speaker (152, 154, or 156).

According to an embodiment, the control unit 230 may control at least one of the magnitude, the time delay, and the output direction of the received acoustic signal to generate the virtual sound source based on an acoustic signal generated when the output acoustic signal output from the left speaker located to the left of the stereophonic sound reproduction apparatus is reflected from the left wall, on an acoustic signal generated when the output acoustic signal output from the right speaker located to the right of the stereophonic sound reproduction apparatus is reflected from the right wall, and on the output acoustic signal output from the front speaker.

According to an embodiment, the control unit 230 may control at least one of a magnitude, a time delay, and an output direction of the left channel signal of the received acoustic signal to generate the first virtual sound source at a first location by using an acoustic signal generated when a left channel signal of the output acoustic signal output from the left speaker 152 is reflected from the left wall 170, an acoustic signal generated when a left channel signal of the output acoustic signal output from the right speaker 154 is reflected from the right wall 175, and a left channel signal of the output acoustic signal output from the front speaker 156.

In addition, according to an embodiment, the control unit 230 may control at least one of a magnitude, a time delay, and an output direction of the received right channel signal to generate the second virtual sound source at a second location by using an acoustic signal generated when a right channel signal of the output acoustic signal output from the left speaker 152 is reflected from the left wall 170, an acoustic signal generated when a right channel signal of the output acoustic signal output from the right speaker 154 is reflected from the right wall 175, and a right channel signal of the output acoustic signal output from the front speaker 156. The first location and the second location may be respectively located to the left and the right of the audience 110 based on a direction in which the audience 110 looks at the stereophonic sound reproduction apparatus 150.

According to an embodiment, the control unit 230 may determine the first location and the second location, which are locations at which the virtual sound source is to be generated, based on spatial characteristics of a sound image provided by the acoustic signal, control at least one of magnitude values of the left channel signal and the right channel signal of the received acoustic signal based on the determined first location and second location, and determine an output acoustic signal to be outputted from each of the left speaker 151 and the front speaker 156.

According to an embodiment, the control unit 230 may determine a distance from the side speaker 151 to the wall and an angle between the side speaker 151 and the wall and control a direction in which the side speaker 151 outputs an acoustic signal as a horizontal or vertical direction with respect to the ground based on the determined distance and angle. An operation performed by the control unit 230 will be described in detail with reference to FIG. 2B later.

The control unit 230 may generate an attenuation signal that is a signal for attenuating or cancelling an inflow acoustic signal to be directly transferred to the audience 110 in the output acoustic signal output from the side speaker 151. The generated attenuation signal may attenuate or cancel the inflow acoustic signal at a location of the audience 110.

According to an embodiment, the control unit 230 may generate a left attenuation signal for attenuating or cancelling, at the location of the audience 110, the left inflow acoustic signal to be directly transferred to the audience 110 without being reflected from the left wall 170 in the output acoustic signal output from the left speaker 152 of the side speaker 151 and a right attenuation signal for attenuating or cancelling, at the location of the audience 110, the right inflow acoustic signal to be directly transferred to the audience 110 without being reflected from the right wall 175 in the output acoustic signal output from the right speaker 154 of the side speaker 151.

According to an embodiment, the control unit 230 may predict an inflow acoustic signal arriving at the location of the audience 110, based on an acoustic transfer function using path information between a location of the side speaker 171 and the location of the audience 110 and generate an attenuation signal based on the predicted inflow acoustic signal and an acoustic transfer function using path information between a location of a speaker outputting the attenuation signal and the location of the audience 110.

According to an embodiment, the output acoustic signal acquired by the control unit 230 may include a control signal in which at least one of the magnitude, the time delay, and the output direction of the received acoustic signal and/or the attenuation signal for attenuating or cancelling the inflow acoustic signal.

The output unit 260 may output the output acoustic signal acquired by the control unit 230, through the side speaker 151 and the front speaker 156. The output acoustic signal may generate a virtual sound source for the received acoustic signal. An output acoustic signal output from the front speaker 156 may include an attenuation signal. According to an embodiment, each output acoustic signal output from the side speaker 151 may include a left channel signal and a right channel signal. According to an embodiment, the output acoustic signal output from the front speaker 156 may include a left channel signal, a right channel signal, and the attenuation signal. According to an embodiment, the left channel signals and the right channel signals output from the side speaker 151 and the front speaker 156 may generate a virtual sound source for the received acoustic signal, and the attenuation signal output from the front speaker 156 may attenuate or cancel the inflow acoustic signal to which the audience 110 listens.

Figure 2B:
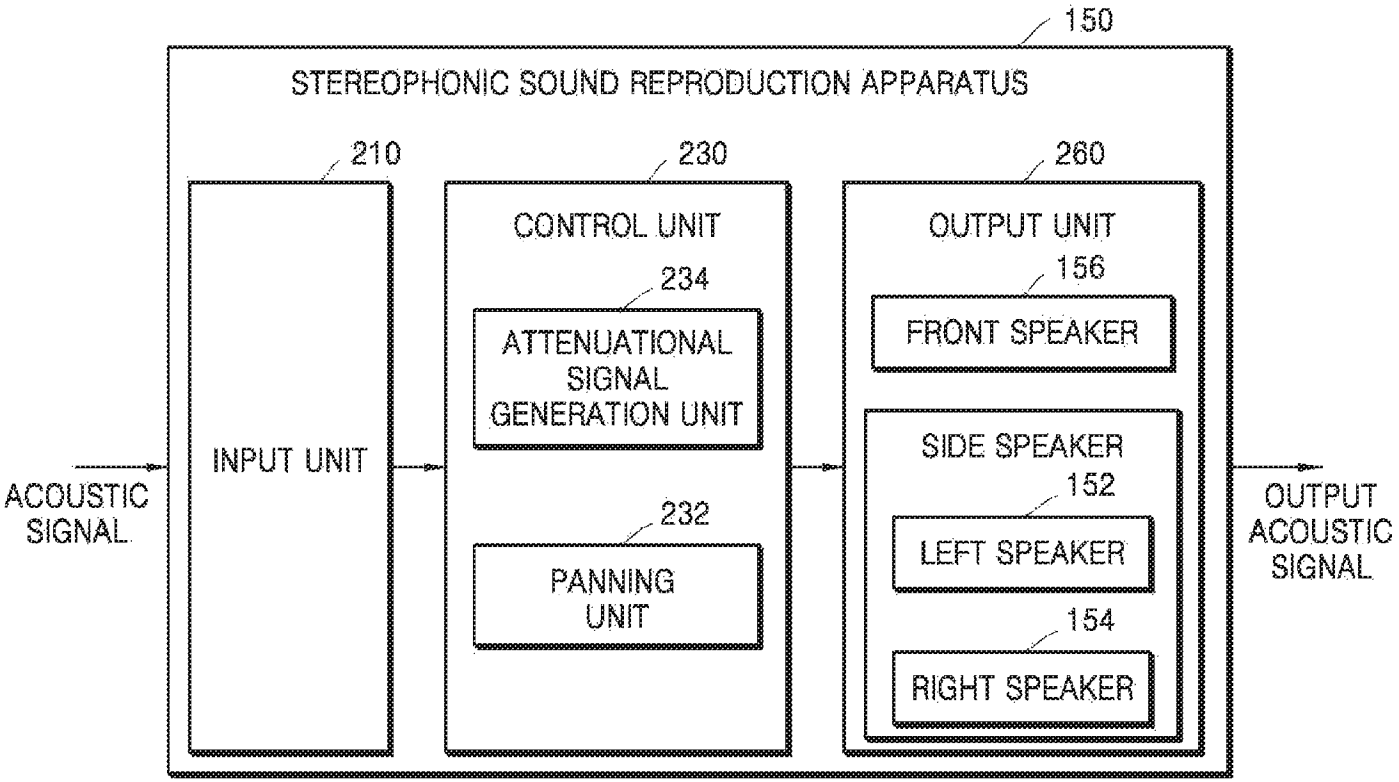
FIG. 2B is a detailed block diagram of the stereophonic sound reproduction apparatus according to an embodiment.

FIG. 2B is a detailed block diagram of the stereophonic sound reproduction apparatus according to an embodiment.

According to an embodiment, the control unit 230 of the stereophonic sound reproduction apparatus 150 may include an attenuation signal generation unit 234 and a panning unit 232.

According to an embodiment, the control unit 230 may acquire, from the received acoustic signal, an output acoustic signal for generating, at the first location, the first virtual sound source for the left channel signal of the received acoustic signal and generating, at the second location, the second virtual sound source for the right channel signal of the received acoustic signal.

According to an embodiment, the panning unit 232 may control the received acoustic signal to generate, at a predetermined location, a left virtual sound source for the left channel signal of the acoustic signal received by the input unit 210 and to generate, at a predetermined location, a right virtual sound source for the right channel signal of the received acoustic signal.

According to an embodiment, the panning unit 232 may control at least one of the magnitude, the time delay, and the output direction of the received acoustic signal to generate, at the predetermined locations, the left virtual sound source and the right virtual sound source by using the acoustic signal generated when the output acoustic signal output from the left speaker 152 is reflected from the left wall 170, the acoustic signal generated when the output acoustic signal output from the right speaker 154 is reflected from the right wall 175, and the output acoustic signal output from the front speaker 156. The output acoustic signal output from the front speaker 156 to be used to generate the left virtual sound source and the right virtual sound source may be a signal obtained by excluding the attenuation signal from the output acoustic signal output from the front speaker 156.

According to an embodiment, the left virtual sound source is a virtual left speaker generated by sound panning of the left speaker 152, the right speaker 154, and the front speaker 156 and indicates a virtual sound source located to the left based on a direction in which the audience 110 looks at the stereophonic sound reproduction apparatus 150, in an external space of the stereophonic sound reproduction apparatus 150. According to an embodiment, the right virtual sound source is a virtual right speaker generated by sound panning of the left speaker 152, the right speaker 154, and the front speaker 156 and indicates a virtual sound source located to the right based on the direction in which the audience 110 looks at the stereophonic sound reproduction apparatus 150, in the external space of the stereophonic sound reproduction apparatus 150.

That is, the left speaker 152 is actually located inside the stereophonic sound reproduction apparatus 150, but the audience 110 may feel that a sound source exists at a location of the left virtual sound source generated by the sound panning. In addition, the right speaker 154 is actually located inside the stereophonic sound reproduction apparatus 150, but the audience 110 may feel that a sound source exists at a location of the right virtual sound source generated by the sound panning.

Figure 3A:
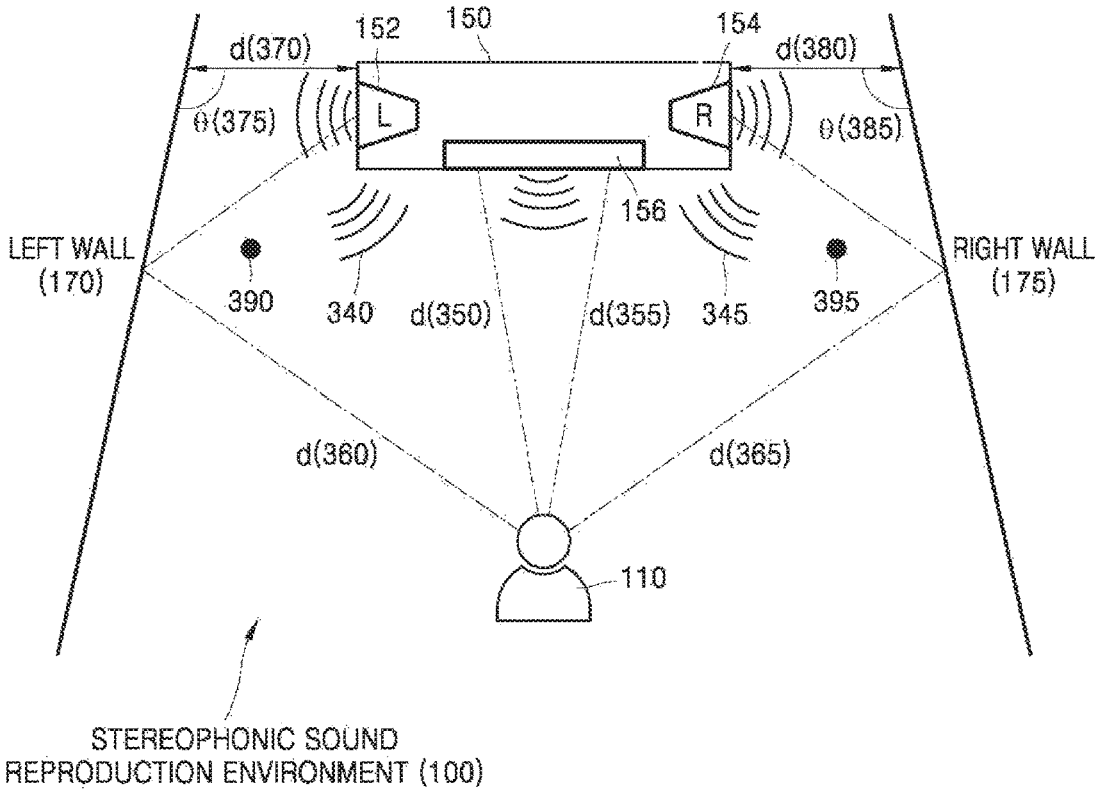
FIG. 3A illustrates various pieces of spatial information of the stereophonic sound reproduction environment of FIG. 1.

Referring to FIG. 3A, according to an embodiment, the stereophonic sound reproduction apparatus 150 may generate a left virtual sound source 390 and a right virtual sound source 395 by using output acoustic signals output from the left speaker 152, the right speaker 154, and the front speaker 156. The left virtual sound source 390 and the right virtual sound source 395 are virtual sound sources generated at respective predetermined locations.

In more detail, according to an embodiment, the panning unit 232 may generate the left virtual sound source 390 at a predetermined location by using the acoustic signal generated when the left channel signal output from the left speaker 152 is reflected from the left wall 170, the acoustic signal generated when the left channel signal output from the right speaker 154 is reflected from the right wall 175, and the left channel signal output from the front speaker 156. According to an embodiment, the panning unit 232 may control at least one of the magnitude, the time delay, and the output direction of the left channel signal of the received acoustic signal to generate the left virtual sound source 390. As a result, the panning unit 232 may determine at least one of the magnitude, the time delay, and the output direction of the left channel signal to be output from each of the left speaker 152, the right speaker 154, and the front speaker 156.

In addition, according to an embodiment, the panning unit 232 may generate the right virtual sound source 395 at a predetermined location by using the acoustic signal generated when the right channel signal output from the left speaker 152 is reflected from the left wall 170, the acoustic signal generated when the right channel signal output from the right speaker 154 is reflected from the right wall 175, and the right channel signal output from the front speaker 156. According to an embodiment, the panning unit 232 may control at least one of the magnitude, the time delay, and the output direction of the right channel signal of the received acoustic signal to generate the right virtual sound source 395. As a result, the panning unit 232 may determine at least one of the magnitude, the time delay, and the output direction of the right channel signal to be output from each of the left speaker 152, the right speaker 154, and the front speaker 156.

According to an embodiment, the attenuation signal generation unit 234 may generate an attenuation signal that is a signal for attenuating or cancelling inflow acoustic signals to be directly transferred to the audience 110 in the output acoustic signals output from the left speaker 152 and the right speaker 154. According to an embodiment, the attenuation signal generation unit 234 may generate the left attenuation signal for attenuating or cancelling, at the location of the audience 110, the left inflow acoustic signal and/or the right attenuation signal for attenuating or cancelling, at the location of the audience 110, the right inflow acoustic signal.

Referring to FIG. 3A, partial signals 340 and 345 of acoustic signals respectively output from the left speaker 152 and the right speaker 154 toward the left wall 170 and the right wall 175 are directly transferred to the audience 110 without being respectively reflected from the left wall 170 and the right wall 175, and these inflow acoustic signals may make a size of a sound field recognized by the audience from the received acoustic signal be reduced and make intelligibility of an acoustic signal to which the audience 110 listens be decreased.

Figure 3B:
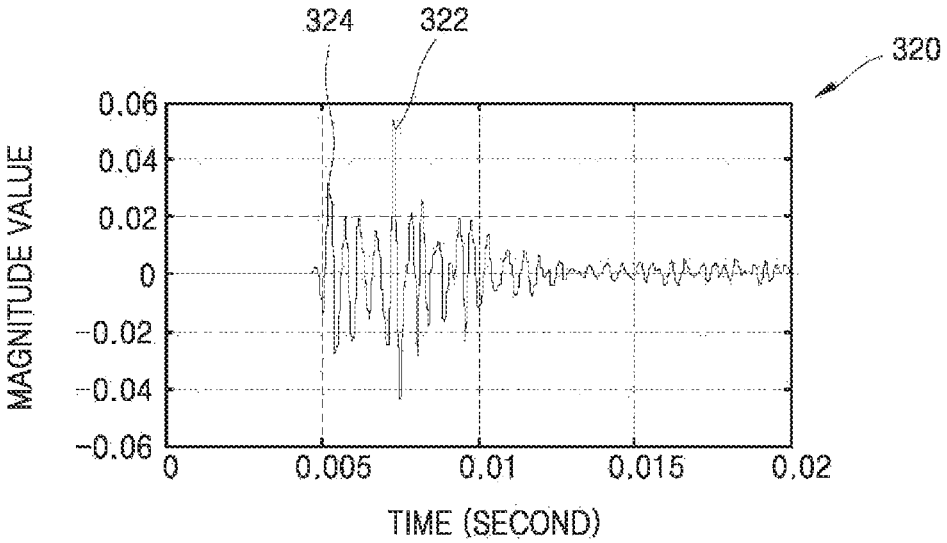
FIG. 3B illustrates graphs showing a magnitude of an acoustic signal output from a side speaker and transferred to an audience, which has been measured at a location of the audience over time.
Figure 3B:
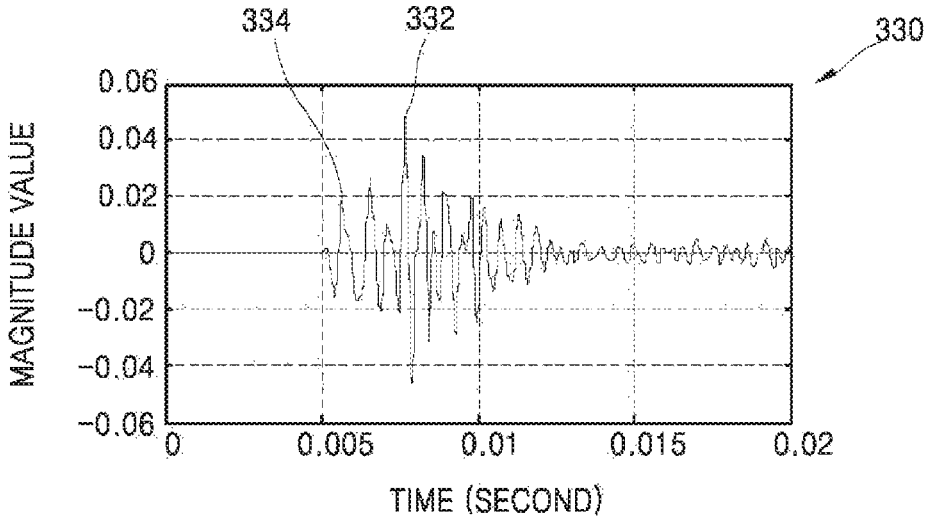

Referring to FIG. 3B, a graph 320 shows values obtained by measuring, at the location of the audience 110 along the lapse of time, a magnitude of an acoustic signal output from the left speaker 152 or the right speaker 154 and transferred to the audience 110.

For example, an output acoustic signal 322 output from the left speaker 152 may be measured by being reflected from the left wall 170, transferred through a path 360, and arriving at the audience 110. However, a portion 324 of an output acoustic signal output from the left speaker 152 may be measured by being directly transferred to the audience 110 without being reflected from the left wall 170. That is, the measured magnitude value 324 is a magnitude value of an inflow acoustic signal transferred to the audience 110.

According to an embodiment, a left attenuation signal output from a speaker in the output unit 260 may be transferred to the location of the audience 110 according to a transfer function and added to a left inflow acoustic signal 340 at the location of the audience 110 so as to attenuate or cancel the left inflow acoustic signal 340. According to an embodiment, the front speaker 156 may include at least one speaker for outputting an attenuation signal, and the attenuation signal may be simultaneously output from the same speaker as a speaker which outputs a controlled acoustic signal. Hereinafter, it is assumed that the front speaker 156 outputs an attenuation signal.

A graph 330 shows values obtained by measuring, at the location of the audience 110 along the lapse of time, a magnitude of an acoustic signal output from the left speaker 152 or the right speaker 154 and transferred to the audience 110 when the attenuation signal generation unit 234 generates a left attenuation signal and a right attenuation signal and the output unit 260 outputs the generated left attenuation signal and right attenuation signal.

For example, the left inflow acoustic signal 340 is attenuated by an attenuation signal output from the front speaker 156, and thus a magnitude value 334 shown in the graph 330 may be less than the magnitude value 324 shown in the graph 320.

According to an embodiment, the attenuation signal generation unit 234 may determine the left attenuation signal and the right attenuation signal to be output from the output unit 260, by using a transfer function based on location information between the side speaker 152 and 154 and the audience 110 and a transfer function based on location information between the front speaker 260, which outputs an attenuation signal, and the audience 110. An operation of generating an attenuation signal will be described in detail with reference to FIG. 4A.

According to an embodiment, the output unit 260 may output the output acoustic signal acquired by the control unit 230, through the left speaker 152, the right speaker 154, and the front speaker 156. According to an embodiment, the output acoustic signal output from the output unit 260 may generate the left virtual sound source and the right virtual sound source. According to an embodiment, the audience 110 may feel that sound sources exist at locations of the left virtual sound source 390 and the right virtual sound source 395 generated by using the left speaker 152, the right speaker 154, and the front speaker 156.

According to an embodiment, the output unit 260 may include speakers for outputting the left attenuation signal and the right attenuation signal generated by the attenuation signal generation unit 234. The front speaker 150 may include at least one speaker for outputting an attenuation signal. A speaker for outputting the attenuation signal may include a speaker for outputting the left attenuation signal and a speaker for outputting the right attenuation signal. The left attenuation signal and the right attenuation signal output from the attenuation signal generation unit 234 may arrive at the location of the audience 110 and respectively be added to the left inflow acoustic signal 340 and a right inflow acoustic signal 345 so as to attenuate or cancel the inflow acoustic signal.

Figure 4A:
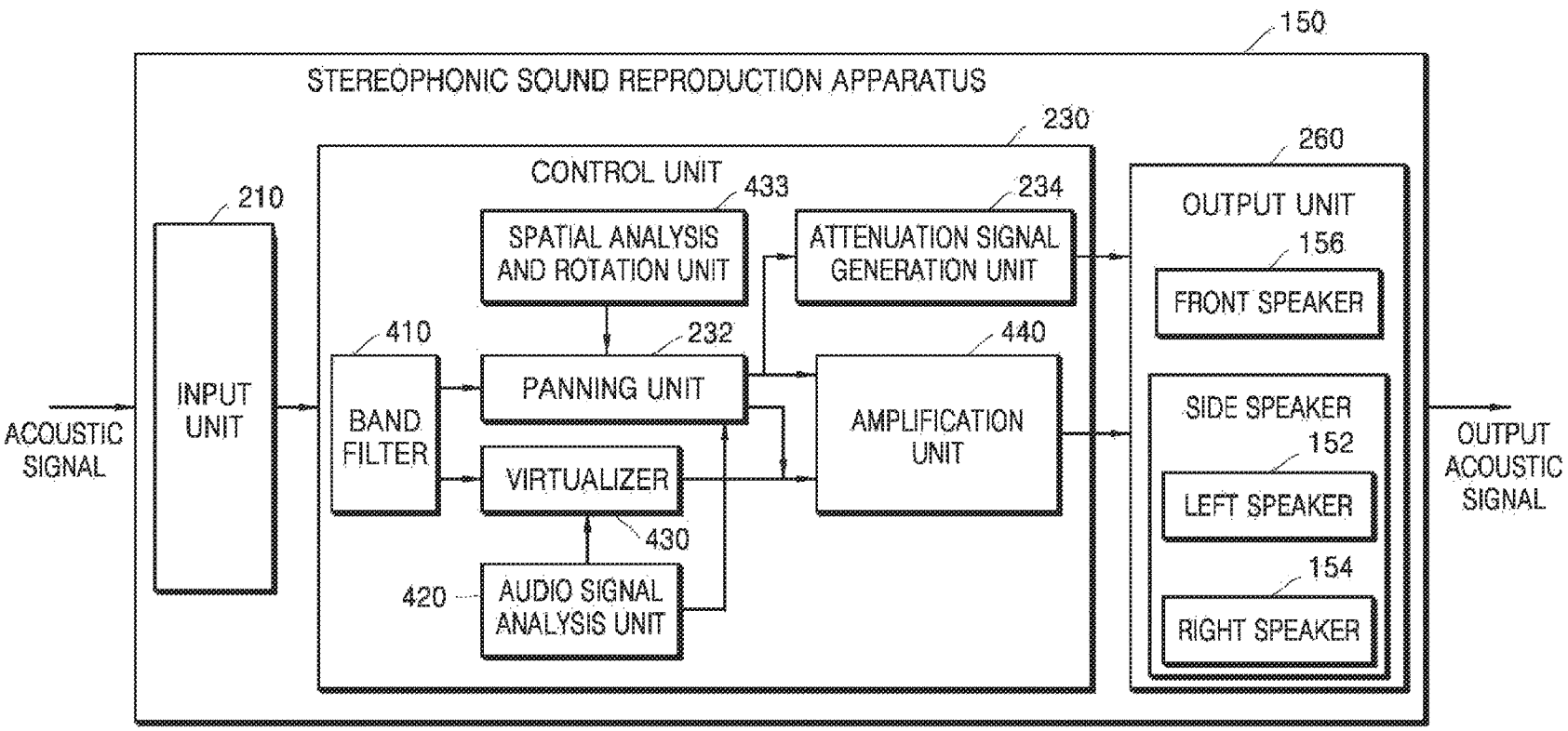
FIG. 4A is a detailed block diagram of the stereophonic sound reproduction apparatus according to an embodiment.

FIG. 4A is a detailed block diagram of the stereophonic sound reproduction apparatus according to an embodiment.

The stereophonic sound reproduction apparatus 150 of FIG. 4A is a detailed embodiment of the stereophonic sound reproduction apparatus 150 of FIG. 2B. Therefore, although omitted hereinafter, the description about the stereophonic sound reproduction apparatus 150 of FIG. 2B is also applied to the stereophonic sound reproduction apparatus 150 of FIG. 4A.

According to an embodiment, the control unit 230 of the stereophonic sound reproduction apparatus 150 may further include a band filter 410, a spatial analysis and rotation unit 433, an acoustic signal analysis unit 420, a virtualizer 430, and an amplification unit 440.

According to an embodiment, the band filter 410 may divide an acoustic signal received by the input unit 210 into a high frequency band and a low frequency band. The band filter 410 may include a high pass filter and a low pass filter. The band filter 410 may be an analog circuit filter or a digital filter but is not limited thereto. The band filter 410 may output a high frequency band signal of the received acoustic signal to the panning unit 232 and output a low frequency band signal thereof to the virtualizer 530. That is, the panning unit 232 may perform sound panning for only the high frequency band signal of the received acoustic signal. The high frequency band signal may be output to the left speaker 152, the right speaker 154, and the front speaker 156, and the low frequency band signal may be output through the front speaker 156.

According to an embodiment, the spatial analysis and rotation unit 433 may analyze spatial characteristics of the stereophonic sound reproduction environment 100. Although FIG. 4A shows that the spatial analysis and rotation unit 433 is separated from the panning unit 232, according to an embodiment, the spatial analysis and rotation unit 433 may be included in the panning unit 232.

According to an embodiment, the spatial analysis and rotation unit 433 may determine, referring back to FIG. 3A, a distance 370 from the left speaker 152 to the left wall 170 and an angle 375 between the left speaker 152 and the left wall 170. In addition, the spatial analysis and rotation unit 433 may determine a distance 380 and an angle 385 between the right speaker 154 and the right wall 175.

According to an embodiment, the spatial analysis and rotation unit 433 may determine the distances 370 and 380 and the angles 375 and 385 by using an audible sound wave, an inaudible sound wave (ultrasonic wave), or an electromagnetic wave. For example, the spatial analysis and rotation unit 433 may determine the distances 370 and 380 by measuring time delays until a reflected wave is detected after an acoustic signal is output to the left wall 170 and the right wall 175. According to an embodiment, the spatial analysis and rotation unit 433 may determine the angles 375 and 385 by outputting an acoustic signal to the left wall 170 and the right wall 175 in one or more directions and measuring, by using a microphone mounted inside the stereophonic sound reproduction apparatus 150, energy of a signal returned when the output acoustic signal is reflected from a wall.

According to an embodiment, the spatial analysis and rotation unit 433 may adjust an acoustic signal output direction of at least one of the left speaker 152 and the right speaker 154 to a direction horizontal or vertical with respect to the ground based on the measured distances 370 and 380 and angles 375 and 385, to generate virtual sound sources at predetermined constant locations 390 and 395.

Figure 5:
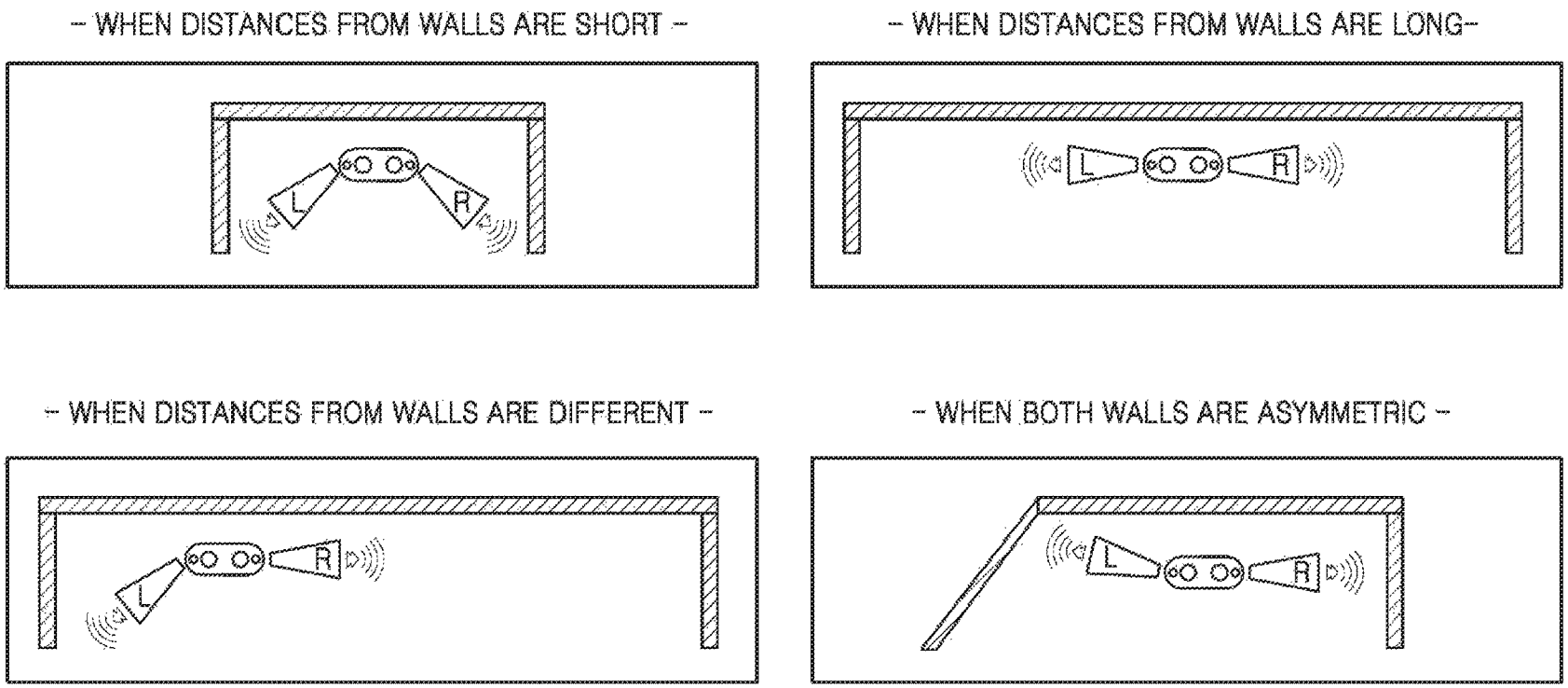
FIG. 5 illustrates an example in which a left speaker and a right speaker in the stereophonic sound reproduction apparatus rotate in a horizontal or vertical direction with respect to the ground.

For example, referring to FIG. 5, when the distances 370 and 380 to side walls are short, the spatial analysis and rotation unit 433 may adjust a horizontal direction of the side speaker 152 and 154 such that the left speaker 152 and the right speaker 154 face the audience 110.

According to an embodiment, when the distances 370 and 380 to the side walls are sufficiently long, the spatial analysis and rotation unit 433 may adjust a horizontal direction of the side speaker 152 and 154 such that the left speaker 152 and the right speaker 154 respectively face the left wall 170 and the right wall 175.

According to an embodiment, when the distance 370 to the left wall 170 is shorter than the distance 380 to the right wall 175, the spatial analysis and rotation unit 433 may adjust a horizontal direction of the side speaker 152 and 154 such that the left speaker 152 faces the audience 110 and the right speaker 154 faces the right wall 175.

According to an embodiment, when the angle 375 to the left wall 170 differs from the angle 385 to the right wall 175, the spatial analysis and rotation unit 433 may adjust a horizontal direction of the side speaker 152 and 154 such that the left speaker 152 faces the opposite direction of the audience 110 and the right speaker 154 faces the right wall 175.

According to an embodiment, the spatial analysis and rotation unit 433 may adjust a vertical direction such that at least one of the left speaker 152 and the right speaker 154 faces the ceiling, thereby reducing an influence of the bottom surface or making the audience 110 feel a sense of elevation.

According to an embodiment, the spatial analysis and rotation unit 233 may physically adjust angles in the horizontal direction and the vertical direction of the left and right speakers 152 and 154 having a horn shape. This will be described below with reference to FIG. 7.

Referring back to FIG. 4A, according to an embodiment, the acoustic signal analysis unit 420 may analyze a sound stage provided by the acoustic signal received by the input unit 210. The sound stage indicates a spatial distribution in which a sound image provided by the received acoustic signal is located.

The sound stage indicates a size of a sound field in which the received acoustic signal is reproduced, wherein a size of a sound stage of an acoustic signal of which a sound image is concentrated to the center is determined to be small, and a size of a sound stage of an acoustic signal of which a sound image is concentrated to the left and the right is determined to be large.

For example, when a speaker outputs an orchestra performance, a musical instrument located at the leftmost of the orchestra, a musical instrument located at the rightmost thereof, a musical instrument recognized to be the closest to an audience, and a musical instrument recognized to be the farthest from the audience in the speaker direction may determine a location and size of a sound stage.

Figure 6:
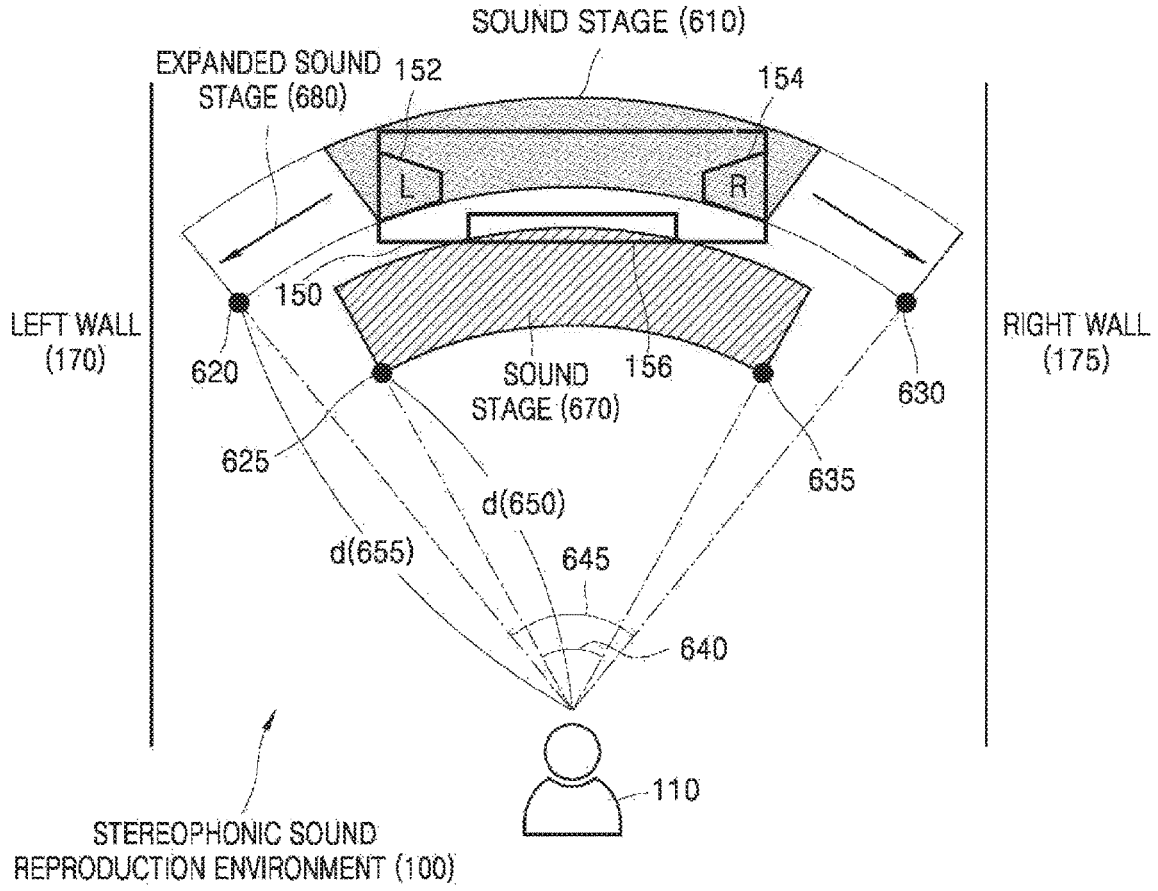
FIG. 6 illustrates a sound stage of an acoustic signal input in the stereophonic sound reproduction environment of FIG. 1.

Referring to FIG. 6, in general, a space 610 between the left speaker 152 and the right speaker 154 may be determined as a sound stage. However, according to an embodiment, the acoustic signal analysis unit 420 may analyze a received acoustic signal and determine a different sound stage suitable for the received acoustic signal.

For example, the acoustic signal analysis unit 420 may determine an appropriate sound stage by analyzing energy of a left channel signal and a right channel signal of the received acoustic signal. When energy of a mono signal is dominant rather than the energy of the left channel signal and the right channel signal of the received acoustic signal, the acoustic signal analysis unit 420 may locate a sound stage 670 at the center and reduce a left and right width. In addition, when the energy of the left channel signal and the right channel signal of the received acoustic signal is much greater than the energy of the mono signal, the acoustic signal analysis unit 420 may use an expanded sound stage 680 which is expanded to the left and the right.

In addition, according to an embodiment, the acoustic signal analysis unit 420 may analyze a correlation between the left channel signal and the right channel signal of the received acoustic signal, determine a size of a sound stage to be small when the correlation is high, and determine a size of a sound stage to be large when the correlation is low. That is, an angle 640 or 645 for determining the sound stage 670 or 680 may be determined inversely proportional to the correlation between the left channel signal and the right channel signal.

In addition, according to an embodiment, the acoustic signal analysis unit 420 may determine a location and a size of a sound stage by analyzing a genre of the received acoustic signal or considering a sense of reverberation.

According to an embodiment, the acoustic signal analysis unit 420 may deliver information about the determined sound stage to the panning unit 232 and the virtualizer 430. For example, the acoustic signal analysis unit 420 may deliver information about a distance 650 and the angle 640 between the audience 110 and the sound stage 670 to the panning unit 232 and the virtualizer 430. In addition, the acoustic signal analysis unit 420 may deliver information about a distance 655 and the angle 645 between the audience 110 and the sound stage 680 to the panning unit 232 and the virtualizer 430.

According to an embodiment, information about a sound stage may include location information of the left virtual sound source 390 and the right virtual sound source 395. That is, when the sound stage 680 is determined for a received acoustic signal, a location of a left virtual sound source to be generated may be determined as a location 620, and a location of a right virtual sound source may be determined as a location 630. In addition, when the sound stage 670 is determined for a received acoustic signal, a location of a left virtual sound source to be generated may be determined as a location 625, and a location of a right virtual sound source may be determined as a location 635.

According to an embodiment, the panning unit 232 may change at least one of a magnitude (gain) and a time delay of each of left channel signals and right channel signals output from the left speaker 152, the right speaker 154, and the front speaker 156 to generate a left virtual sound source and a right virtual sound source at predetermined constant locations. As described above, the locations of the left virtual sound source and the right virtual sound source may be determined from information about a sound stage, which has been received from the acoustic signal analysis unit 420.

According to an embodiment, the panning unit 232 may determine magnitudes of the left channel signals and the right channel signals to be output from the left speaker 152, the right speaker 154, and the front speaker 156 such that the magnitudes are different, by considering directivity according to frequencies of acoustic signals output from the left speaker 152 and the right speaker 154.

According to an embodiment, the panning unit 232 may form virtual sound sources at the constant locations 390 and 395 regardless of frequencies of output acoustic signals by considering that as an output acoustic signal output from the side speaker 152 and 154 has a high frequency, directivity is improved such that a sound image is generated closely to the side wall 170 and 175, and as an output acoustic signal output from the side speaker 152 and 154 has a low frequency, directivity is reduced such that a sound image is generated closely to the side speaker 152 and 154.

According to an embodiment, the panning unit 232 may simultaneously use left channel signals output from at least two speakers of the left speaker 152, the right speaker 154, and the front speaker 156 to generate the left virtual sound source 390 at a constant location regardless of frequency. The front speaker 156 used to generate the left virtual sound source 390 at a constant location may be a tweeter speaker located to the left of the front speaker 156.

According to an embodiment, the panning unit 232 may increase a magnitude of a left channel signal to be output from the right speaker 154 by considering that directivity of a left channel signal output from the left speaker 152 increases as a frequency of a left channel signal of a received acoustic signal is high. In addition, according to an embodiment, the panning unit 232 may increase a magnitude of a right channel signal to be output from the left speaker 152 by considering that directivity of a right acoustic signal output from the right speaker 154 increases as a frequency of a right channel signal of a received acoustic signal is high.

Figure 7:
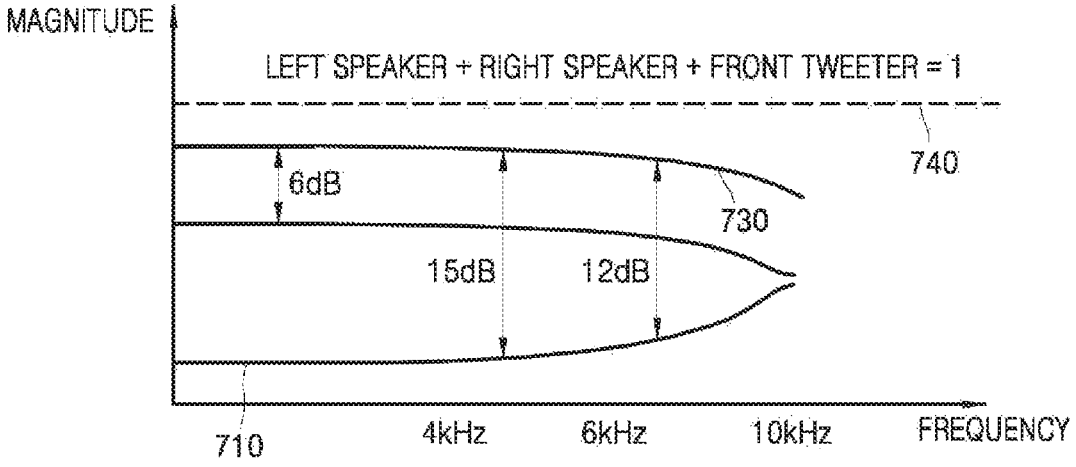
FIG. 7 illustrates a relationship between a frequency of an acoustic signal and magnitudes of acoustic signals output from a left speaker and a right speaker, according to an embodiment.

For example, referring to FIG. 7, lines 730 and 710 may indicate a magnitude of a left channel signal output from any one speaker of the left speaker 152 and the right speaker 154 according to frequency. For example, when the line 730 indicates a left channel signal output from the left speaker 152, the line 710 may indicate a left channel signal output from the right speaker 154, and a line 720 may indicate a left acoustic signal output from a tweeter speaker located to the left of the front speaker 156.

If the line 730 indicates a right channel signal output from the right speaker 154, the line 710 may indicate a right channel signal output from the left speaker 152, and the line 720 may indicate a right channel signal output from a tweeter speaker located to the right of the front speaker 156. Hereinafter, for convenience of description, it is assumed that the line 730 indicates a left channel signal output from the left speaker 152.

According to an embodiment, a sum of left channel signals output from the left speaker 152, the right speaker 154, and the left tweeter speaker of the front speaker 156 is a constant value 740.

Since directivity of a left channel signal output from the left speaker 152 increases as a frequency is high, a virtual sound source generated by the left speaker 152 is generated closely to the left wall 170 when only the left speaker 152 is used, and thus it is needed to move the virtual sound source in the right direction to generate a left virtual sound source at a desired location 390.

Therefore, according to an embodiment, the panning unit 232 may increase a magnitude of a left channel signal to be output from at least one speaker of the front speaker 156 and the right speaker 154 as a frequency of a left channel signal output from the left speaker 152 is high. On the contrary, according to an embodiment, the panning unit 232 may decrease a magnitude of a left channel signal to be output from at least one speaker of the front speaker 156 and the right speaker 154 as a frequency of a left channel signal output from the left speaker 152 is low.

According to an embodiment, the control unit 230 may determine a time delay of output acoustic signals output from the left speaker 152 and the right speaker 154 such that an output acoustic signal output from the side speaker 152 and 154, reflected from the side wall 170 and 175, and arriving at the audience 110 and an output acoustic signal output from the front speaker 156 and directly transferred to the audience 110 arrive at the audience 110 at the same time.

Referring back to FIG. 3A, according to an embodiment, the panning unit 232 may determine a length 360 of a path along which an output acoustic signal output from the left speaker 152 arrives at the audience 110 after being reflected from the left wall 170. In addition, according to an embodiment, the control unit 230 may determine a length 350 of a path along which an output acoustic signal output from the front speaker 156 is directly transferred to the audience 110. According to an embodiment, the panning unit 232 may delay a time of an output acoustic signal to be output from the left speaker 152 by (the length 360−the length 350)/$C_0$ than an output acoustic signal to be output from the front speaker 156, to maintain articulation by making the output acoustic signal output from the left speaker 152 and the output acoustic signal output from the front speaker 156 arrive at the audience 110 at the same time.

In addition, according to an embodiment, the panning unit 232 may determine a length 365 of a path along which an output acoustic signal output from the right speaker 154 arrives at the audience 110 after being reflected from the right wall 175. In addition, according to an embodiment, the control unit 230 may determine a length 355 of a path along which an output acoustic signal output from the front speaker 156 is directly transferred to the audience 110. According to an embodiment, the panning unit 232 may delay a time of an output acoustic signal to be output from the right speaker 154 by (the length 365−the length 355)/$C_0$ than an output acoustic signal to be output from the front speaker 156, to maintain articulation by making the output acoustic signal output from the right speaker 154 and the output acoustic signal output from the front speaker 156 arrive at the audience 110 at the same time.

According to an embodiment, the panning unit 232 may compare the length 360 and the length 365 to determine a magnitude of an output acoustic signal to be out from a speaker having a longer length such that the magnitude is greater than the other.

According to an embodiment, when the panning unit 232 determines a left channel signal and a right channel signal to be output from the left speaker 152 and the right speaker 154, the attenuation signal generation unit 234 may predict the left inflow acoustic signal 340 and the right inflow acoustic signal 355 based on the determined acoustic signals and generate a left attenuation signal and a right attenuation signal for respectively attenuating or cancelling the predicted inflow acoustic signals.

Figure 4B:
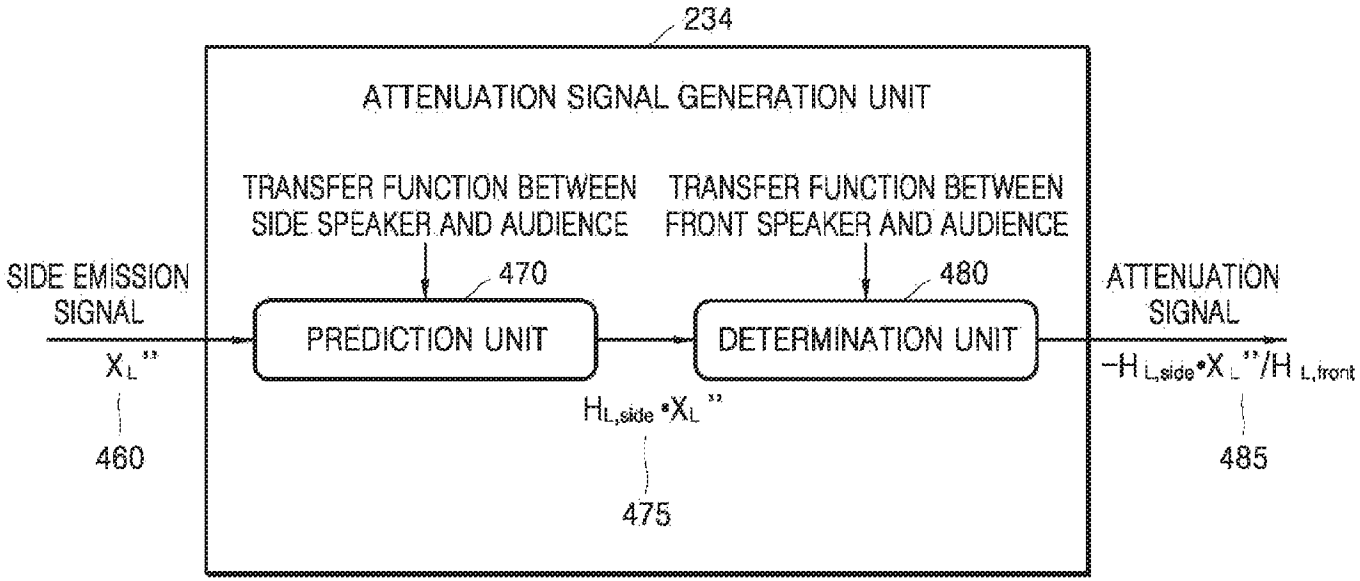
FIG. 4B is a block diagram of an attenuation signal generation unit according to an embodiment.

FIG. 4B is a block diagram of an attenuation signal generation unit according to an embodiment.

According to an embodiment, the attenuation signal generation unit 234 may include a prediction unit 470 and a determination unit 480.

According to an embodiment, the prediction unit 470 may predict a left inflow acoustic signal or a right inflow acoustic signal which arrives at the audience 110 by being directly transferred thereto without being reflected from the left wall 170 or the right wall 175 in an output acoustic signal output from the left speaker 152 or the right speaker 154. According to an embodiment, the prediction unit 470 may receive, from the panning unit 232, information about an output acoustic signal to be output from the left speaker 152 or the right speaker 154. The left inflow acoustic signal or the right inflow acoustic signal indicate an inflow acoustic signal generated from the output acoustic signal output from the left speaker 152 and an inflow acoustic signal generated from the output acoustic signal output from the right speaker 154, respectively.

According to an embodiment, the prediction unit 470 may predict a left inflow acoustic signal arriving at the location of the audience 110 as $H_{L,side} \cdot X_L''$ 475 by applying an acoustic transfer function $H_{L,side}$ based on path information between the left speaker 152 and the audience 110 to an output acoustic signal $X_L''$ 460 to be output from the left speaker 152. That is, the left inflow acoustic signal measurable at the location of the audience 110 may be predicted as $H_{L,side} \cdot X_L''$ 475.

According to an embodiment, the determination unit 480 may determine an attenuation signal for attenuating or cancelling, at the location of the audience 110, the inflow acoustic signal predicted by the prediction unit 470. According to an embodiment, the determination unit 480 may determine, as $-H_{L,side} \cdot X_L''$ (that is, a left attenuation signal arriving at the location of the audience 110), a left attenuation signal for attenuating or cancelling, at the location of the audience 110, the left inflow acoustic signal $H_{L,side} \cdot X_L''$ 475 predicted by the prediction unit 470. In addition, the determination unit 480 may determine, as $-H_{L,side} \cdot X_L''/H_{L,front}$ 485, a left attenuation signal to be output from the front speaker 156 by applying a transfer function $H_{L,front}$ to the left attenuation signal $-H_{L,side} \cdot X_L''$ at the location of the audience 110. $H_{L,front}$ is an acoustic transfer function based on path information between a location of a speaker which outputs a left attenuation signal and the audience 110. That is, the determination unit 480 may determine a left attenuation signal to be output from the front speaker 156 by inversely applying an acoustic transfer function based on path information between a location of a speaker which outputs an attenuation signal and the audience 110 to an attenuation signal to be transferred to the location of the audience 110.

According to an embodiment, the left attenuation signal $-H_{L,side} \cdot X_L''/H_{L,front}$ 485 output from the front speaker 156 is transferred to the location of the audience 110 through the acoustic transfer function $H_{L,front}$, and thus an attenuation signal arriving at the location of the audience 110 becomes $-H_{L,side} \cdot X_L''$ and may cancel the left inflow acoustic signal $H_{L,side} \cdot X_L''$ 475 arriving at the location of the audience 110. An acoustic transfer function may be information previously given based on characteristics of the stereophonic sound reproduction environment 100, and the characteristics of the stereophonic sound reproduction environment 100 may include information about a distance between speaker units, an output angle, and the like.

Referring back to FIG. 4A, the virtualizer 430 may perform rendering for localizing a virtual sound source at a predetermined location with respect to a low frequency band signal in a received acoustic signal. For example, the virtualizer 430 may acquire an acoustic signal of the front speaker, which corresponds to the low frequency band signal, by processing the received acoustic signal through a head related transfer function rendering algorithm, a beamforming rendering algorithm, or a focused source rendering algorithm.

For example, the virtualizer 430 may make the low frequency band signal pass through a predetermined head related transfer filter (HRTF). The HRTF includes path information from a spatial location of a sound source to both ears of the audience 110, i.e., a frequency transfer characteristic. The HRTF enables a stereophonic sound to be recognized by not only simple path differences such as an inter-aural level difference (ILD) and an inter-aural time difference (ITD) but also a phenomenon that complex path characteristics such as diffraction on the head surface and reflection from an auricle change according to a sound arrival direction. Since the HRTF has a unique characteristic in each spatial direction, when this characteristic is used, a stereophonic sound may be generated. That is, the virtualizer 430 may expand a sound state by using a predetermined head related transfer function to localize the low frequency band signal at a predetermined location.

According to an embodiment, the amplification unit 440 may amplify (or attenuate) a received acoustic signal according to a gain value determined by the panning unit 232 and the virtualizer 430.

For example, the amplification unit 440 may amplify, according to a first gain value, a left channel signal to be output to the left speaker 152 and amplify, according to a second gain value, a left channel signal to be output to the right speaker 154. In addition, the amplification unit 440 may amplify, according to the first gain value, a right channel signal to be output to the right speaker 154 and amplify, according to the second gain value, a right channel signal to be output to the left speaker 152.

In addition, according to an embodiment, the amplification unit 440 may amplify, according to a third gain value and a fourth gain value, a right channel signal and a left channel signal to be output to the front speaker 156, respectively. According to an embodiment, the amplification unit 440 may differently determine gain values of output acoustic signals to be output to a left tweeter speaker, a right tweeter speaker, a left mid-range speaker, and a right mid-range speaker of the front speaker 156, respectively.

According to an embodiment, the amplification unit 540 may include an equalizer (not shown). The equalizer may process and adjust a general frequency characteristic of a received acoustic signal so as to maintain an appropriate pitch. The equalizer may be coupled to the virtualizer 430 to correct the received acoustic signal such that a tone is not changed regardless of a frequency. In addition, the equalizer may maintain a frequency response according to signal processing of the panning unit 232 to be constant at the location of the audience 110.

Figure 8A:
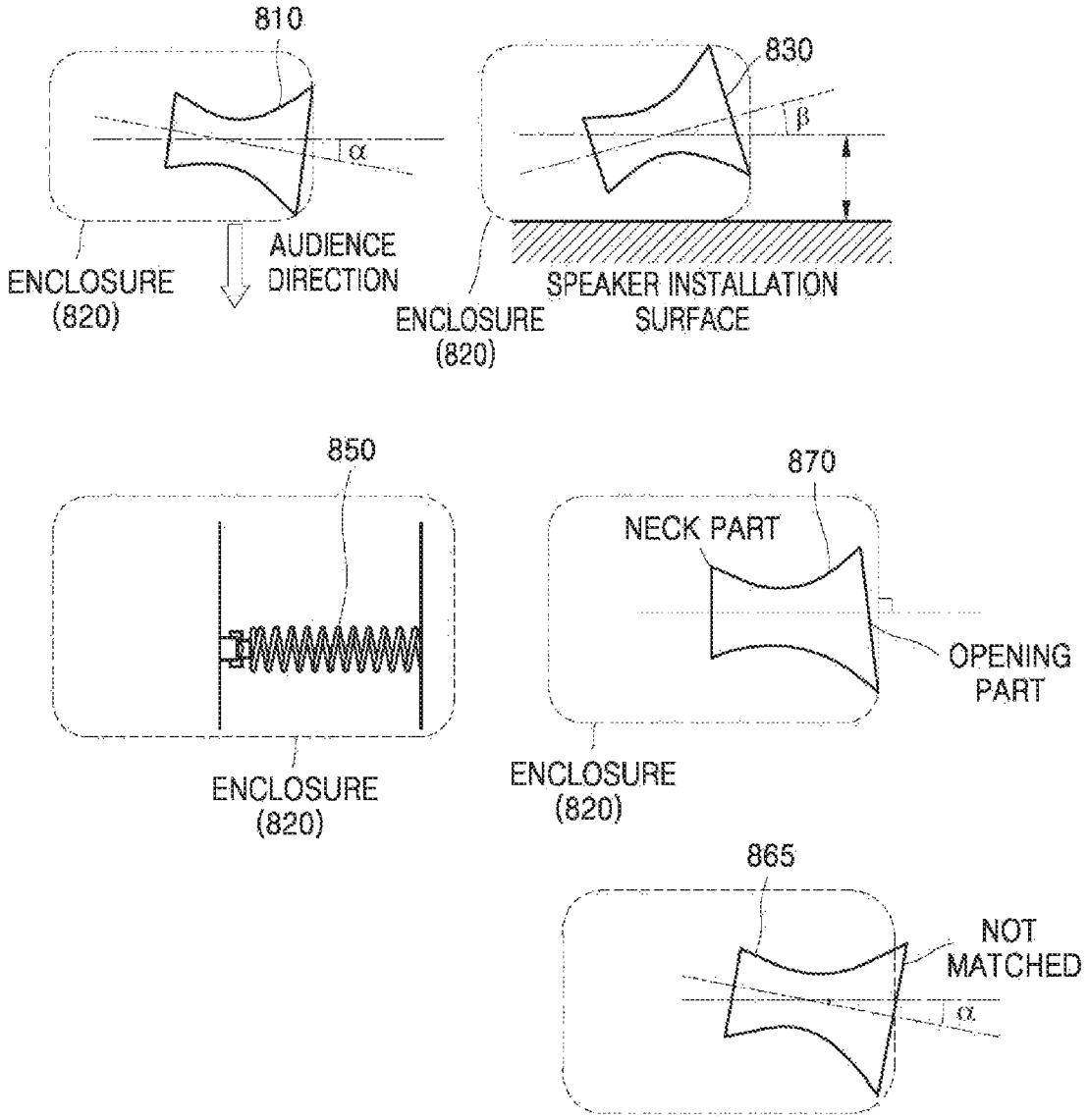
FIG. 8A illustrates various shapes of a horn-shaped side speaker.
Figure 8B:
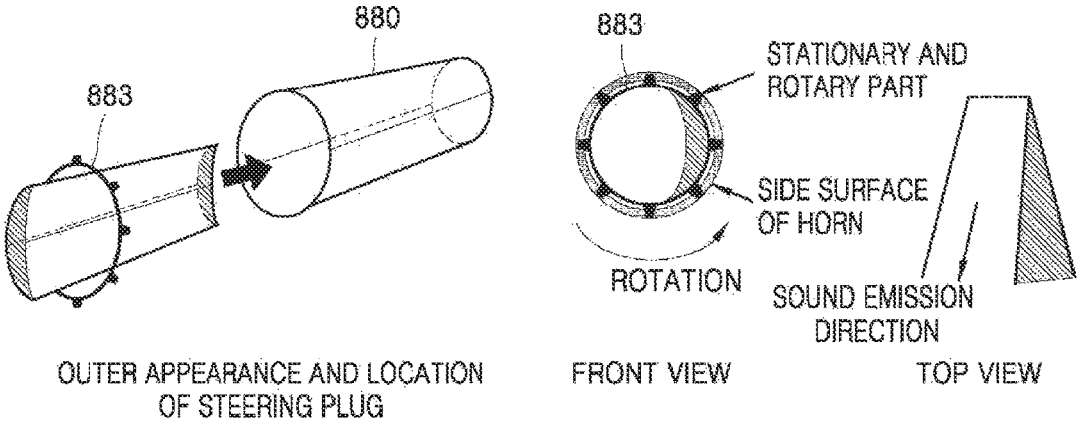
FIG. 8B illustrates a structure for rotating a horn-shaped side speaker, according to an embodiment.

FIG. 8 illustrates various shapes of a horn-shaped side speaker.

As described above, according to an embodiment, the side speaker 152 and 154 may have a horn shape such that an acoustic signal output in a direction of the side wall 170 and 175. The horn may include a horn tube-shaped frame including a neck part and an opening part.

According to an embodiment, a horn 810 of the left speaker 152 and the right speaker 154 may be inclined by an angle $\alpha$ in a direction of the audience 110 within an enclosure 820 such that a reflected wave from the side wall 170 and 175 moves to the audience 110. The enclosure 820 may be a speaker enclosure included in the stereophonic sound reproduction apparatus 100.

According to an embodiment, a horn 830 of the left speaker 152 and the right speaker 154 may be inclined upward by an angle $\beta$ within the enclosure 820 so as to reduce an influence of reflection due to the bottom surface.

According to an embodiment, a horn of the left speaker 152 and the right speaker 154 may be inclined by an angle $\gamma$ in a horizontal direction with respect to the ground and by an angle $\delta$ in a vertical direction with respect to the ground within the enclosure 820. When the horn of the left speaker 152 and the right speaker 154 is inclined by the angle $\delta$ in the vertical direction, a virtual sound source is located at a predetermined elevation such that the audience 110 may feel a sense of elevation.

According to an embodiment, a horn 840 of the left speaker 152 and the right speaker 154 may have a helical shape within the enclosure 820. As a length of a horn is long in an output direction of an acoustic signal, and as a size of an entrance through which the acoustic signal is output is large, the acoustic signal has high directivity in a specific frequency band.

That is, as a length of a horn of the left speaker 152 and the right speaker 154 is long, directivity increases, but a speaker having a long horn is long and has a shape in which a cross-sectional area thereof is wider in a direction to the left and the right based on a neck part, and thus a volume is expanded, thereby making it difficult to produce, install, and carry the speaker. In addition, since a horn also influences a size and an outer appearance of an enclosure of a speaker, as the size of the enclosure is small, a physical limited distance of the horn may be short.

Therefore, according to an embodiment, a horn 850 of the left speaker 152 and the right speaker 154 may have a helical shape instead of a straight shape to have high directivity with a small volume.

According to an embodiment, a shape of an opening part of a horn 870 of the left speaker 152 and the right speaker 154 may be changed according to a shape of the enclosure 820.

As described above, since a horn of the left speaker 152 and the right speaker 154 may be inclined in the horizontal or vertical direction with respect to the ground within the enclosure 820, an inclined horn 865 may be not matched with a shape of the enclosure 820 formed with straight lines and planar surfaces. For example, the horn 865 may be inclined by the angle $\alpha$ in the horizontal direction with respect to the ground within the enclosure, such that the horn 865 is not matched with the shape of the enclosure 820. Therefore, the horn 870 of the left speaker 152 and the right speaker 154 may have a changed shape of an opening part so as to be fit to the shape of the enclosure 820. That is, the opening part of the horn 870 may be cut obliquely in the horizontal or vertical direction with respect to the ground so as to be fit to the shape of the enclosure 820. In this case, an output pattern of an acoustic signal of the horn 870 may be maintained.

According to an embodiment, a steering plug 883 by which an output direction of a horn 880 of the left speaker 152 and the right speaker 154 is easily adjustable through rotation may be located inside the horn 880.

Figure 9:
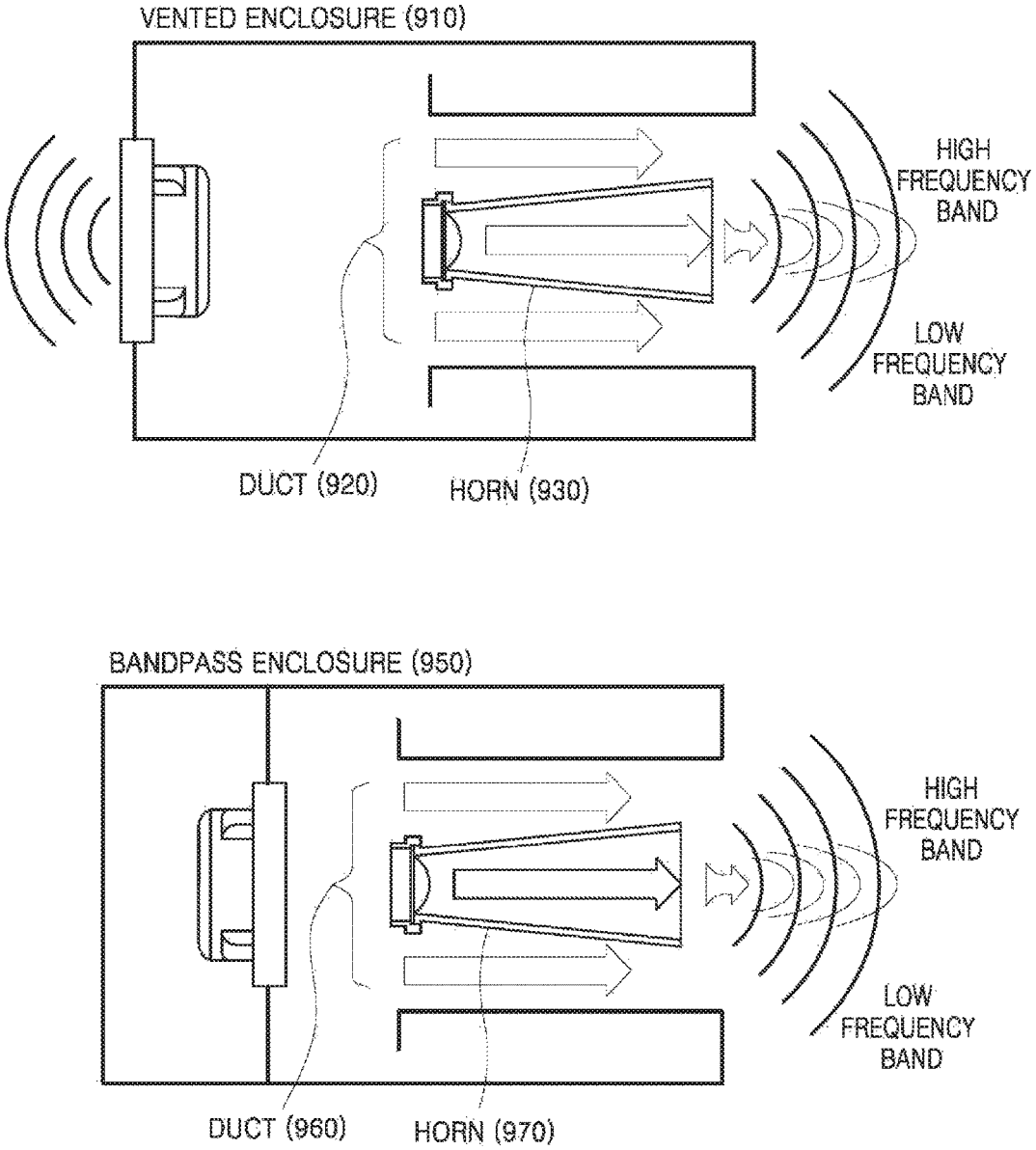
FIG. 9 illustrates shapes of an enclosure included in the stereophonic sound reproduction apparatus, according to an embodiment.

FIG. 9 illustrates shapes of an enclosure included in the stereophonic sound reproduction apparatus, according to an embodiment.

As described above, as a horn is long, matching with air is good, and thus efficiency is improved, but a speaker having a long horn is long and has a shape in which a cross-sectional area thereof is wider in a direction to the left and the right based on a neck part, and thus a volume is expanded, thereby making a total volume of the stereophonic sound reproduction apparatus 150 expanded.

According to an embodiment, the stereophonic sound reproduction apparatus 150 may include the side speaker 152 and 154 inside a woofer enclosure in the stereophonic sound reproduction apparatus 150 so as to be miniaturized.

In more detail, according to an embodiment, the stereophonic sound reproduction apparatus 150 may include a horn of the side speaker 152 and 154 in a duct that is a low frequency band acoustic signal discharge hole. For example, ducts 920 and 960 inside a vented enclosure 810 and a bandpass enclosure 850 may include horns 930 and 970, respectively.

Therefore, according to an embodiment, a high frequency band output from a horn of the side speaker 152 and 154 and a low frequency band output from a woofer may be simultaneously output from the duct 920 or 960. Even though the horn 930 or 970 exists together inside the duct 920 or 960, since a low frequency band acoustic signal output from a woofer and a high frequency band acoustic signal output from the horn 930 or 970 have different frequency bands, an interference phenomenon such as constructive interference or destructive interference of an acoustic signal does not occur.

Figure 10:
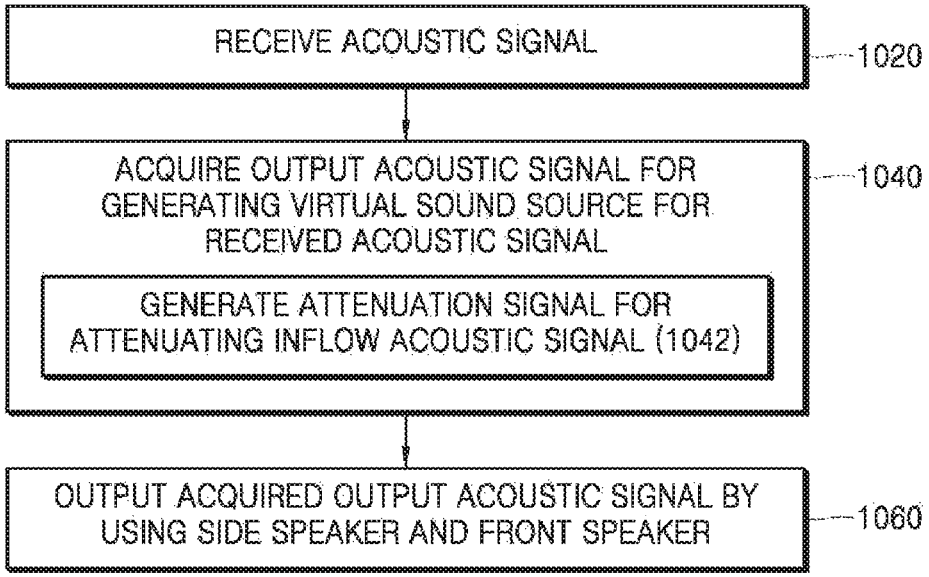
FIG. 10 is a flowchart of a method by which a stereophonic sound reproduction apparatus reproduces a stereophonic sound, according to an embodiment.

FIG. 10 is a flowchart of a method by which a stereophonic sound reproduction apparatus reproduces a stereophonic sound, according to an embodiment.

In operation 1020, the stereophonic sound reproduction apparatus 150 may receive an acoustic signal. According to an embodiment, the stereophonic sound reproduction apparatus 150 may receive an acoustic signal from an external device such as a television, a computer, a smartphone, or a tablet PC through a communication path.

In operation 1040, an output acoustic signal for generating a virtual sound source for the received acoustic signal may be acquired from the received acoustic signal. According to an embodiment, the stereophonic sound reproduction apparatus 150 may control the received acoustic signal to generate a left virtual sound source and a right virtual sound source for the received acoustic signal. Operation 1040 may include operation 1042 of generating an attenuation signal for attenuating or cancelling an inflow acoustic signal.

In operation 1042, the stereophonic sound reproduction apparatus 150 according to an embodiment may generate an attenuation signal for attenuating or cancelling an inflow acoustic signal to be directly transferred to an audience in an output acoustic signal to be output from the side speaker 151.

According to an embodiment, the stereophonic sound reproduction apparatus 150 may generate a left attenuation signal for attenuating or cancelling, at the location of the audience 110, a left inflow acoustic signal to be directly transferred to the audience 110 without being reflected from the left wall 170 in an output acoustic signal output toward the left wall 170 from the left speaker 152 and a right attenuation signal for attenuating or cancelling, at the location of the audience 110, a right inflow acoustic signal to be directly transferred to the audience 110 without being reflected from the right wall 175 in an output acoustic signal output toward the right wall 175 from the right speaker 154.

According to an embodiment, the stereophonic sound reproduction apparatus 150 may predict a left inflow acoustic signal to be transferred to the location of the audience 110 by applying an acoustic transfer function based on path information between a location of the left speaker 152 and the location of the audience 110 to the output acoustic signal to be output toward the left wall 170 from the left speaker 152 and predict a right inflow acoustic signal to be transferred to the location of the audience 110 by applying an acoustic transfer function based on path information between a location of the right speaker 154 and the location of the audience 110 to the output acoustic signal to be output toward the right wall 175 from the right speaker 154, to generate the attenuation signal.

According to an embodiment, the stereophonic sound reproduction apparatus 150 may determine a left attenuation signal to be output from a speaker by inversely applying an acoustic transfer function based on path information between a location of the speaker which outputs the left attenuation signal and the location of the audience 110 to an acoustic signal for attenuating or cancelling, at the location of the audience 110, the predicted left inflow acoustic signal. In addition, the stereophonic sound reproduction apparatus 150 may determine a right attenuation signal to be output from a speaker by inversely applying an acoustic transfer function based on path information between a location of the speaker which outputs the right attenuation signal and the location of the audience 110 to an acoustic signal for attenuating or cancelling, at the location of the audience 110, the predicted right inflow acoustic signal.

In operation 1060, the stereophonic sound reproduction apparatus 150 may output the output acoustic signal acquired in operation 1040 by using the side speaker 151 and the front speaker 156. The output acoustic signal output through the side speaker 151 and the front speaker 156 may generate a virtual sound source. The output acoustic signal output through the front speaker 156 may include the attenuation signal generated in operation 1042.

Figure 11:
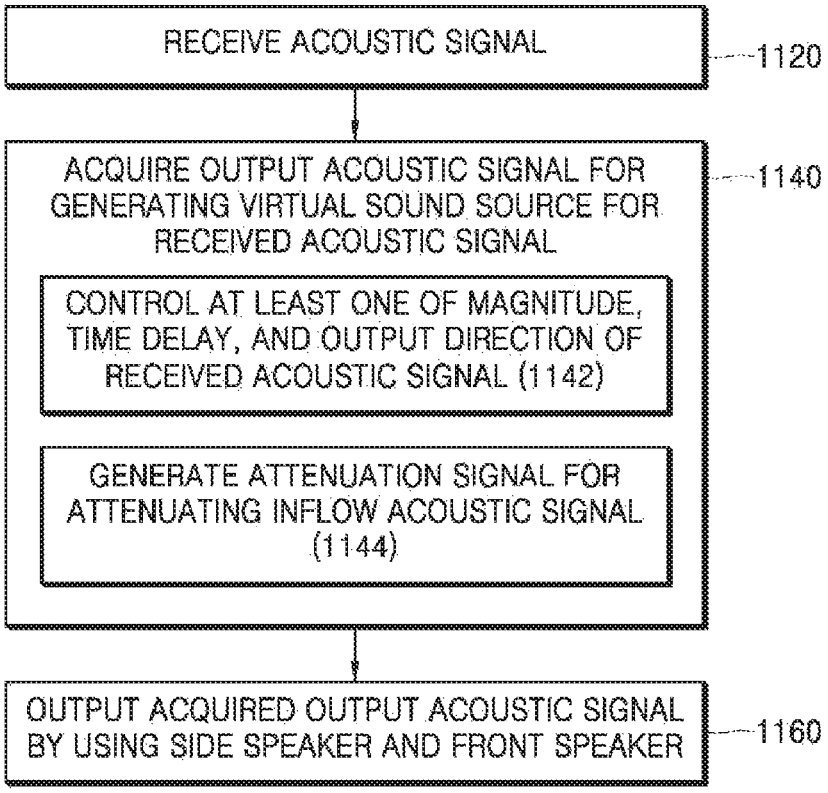
FIG. 11 is a detailed flowchart of a method by which a stereophonic sound reproduction apparatus reproduces a stereophonic sound, according to an embodiment.

FIG. 11 is a detailed flowchart of a method by which a stereophonic sound reproduction apparatus reproduces a stereophonic sound, according to an embodiment.

Operations 1120, 1140, 1144, and 1160 correspond to operations 1020, 1040, 1042, and 1060 of FIG. 10, and thus a detailed description thereof will be omitted herein.

Operation 1140 may include operation 1142 of controlling at least one of a magnitude, a time delay, and an output direction of an acoustic signal received in operation 1020.

In operation 1142, the stereophonic sound reproduction apparatus 150 according to an embodiment may acquire an output acoustic signal for generating a virtual sound source by controlling at least one of the magnitude, the time delay, and the output direction of the received acoustic signal.

According to an embodiment, the stereophonic sound reproduction apparatus 150 may control at least one of the magnitude, the time delay, and the output direction of the received acoustic signal to generate a left virtual sound source at a predetermined location by using an acoustic signal generated when a left channel signal output from the left speaker 152 is reflected from the left wall 170, an acoustic signal generated when a left channel signal output from the right speaker 154 is reflected from the right wall 175, and a left channel signal output from the front speaker 156.

In addition, according to an embodiment, the stereophonic sound reproduction apparatus 150 may control at least one of the magnitude, the time delay, and the output direction of the received acoustic signal to generate a right virtual sound source at a predetermined location by using an acoustic signal generated when a right channel signal output from the left speaker 152 is reflected from the left wall 170, an acoustic signal generated when a right channel signal output from the right speaker 154 is reflected from the right wall 175, and a right channel signal output from the front speaker 156.

According to an embodiment, the predetermined location at which the left virtual sound source is located may be located to the left based on a direction in which an audience looks at the stereophonic sound reproduction apparatus in a space outside the stereophonic sound reproduction apparatus 150, and the predetermined location at which the right virtual sound source is located may be located to the right based on the direction in which the audience looks at the stereophonic sound reproduction apparatus in the space outside the stereophonic sound reproduction apparatus 150.

According to an embodiment, the stereophonic sound reproduction apparatus 150 may determine locations of the left virtual sound source and the right virtual sound source by analyzing a sound stage provided by the acoustic signal received in operation 1020 and control at least one of gains, time delays, and output directions of left channel signals and right channel signals to be output from the left speaker 152, the right speaker 154, and the front speaker 156 so as to localize the left virtual sound source and the right virtual sound source at the determined locations.

According to an embodiment, the stereophonic sound reproduction apparatus 150 may determine a distance and an angle between the left speaker 152 and the left wall 170 and a distance and an angle between the right speaker 154 and the right wall 175 and change at least one of gains and delay values of the left channel signals and the right channel signals to be output from the left speaker 152, the right speaker 154, and the front speaker 156, based on the determined distances and angles. In addition, the stereophonic sound reproduction apparatus 150 may adjust output directions of the left speaker 152, the right speaker 154, and the front speaker 156 in a horizontal or vertical direction based on the determined distances and angles.

In operation 1142, when at least one of the magnitude, the time delay, and the output direction of the received acoustic signal is controlled, magnitudes, time delays, and output directions of an output acoustic signal to be output from the left speaker 152, an output acoustic signal to be output from the right speaker 154, and an output acoustic signal to be output from the front speaker 156 may be determined. Each of the output acoustic signals output from the left speaker, the right speaker, and the front speaker may include a left channel signal and a right channel signal.

In operation 1144, the stereophonic sound reproduction apparatus 150 according to an embodiment may predict an inflow acoustic signal to be listened to by the audience 110, based on the acoustic signal to be output from each speaker, which has been determined in operation 1142, and generate an attenuation signal for attenuating or cancelling the predicted inflow acoustic signal. According to an embodiment, the stereophonic sound reproduction apparatus 150 may predict a left inflow acoustic signal to be transferred to the audience 110, based on an acoustic signal to be output from the left speaker 152, and determine a left attenuation signal for attenuating or cancelling the predicted left inflow acoustic signal. In addition, according to an embodiment, the stereophonic sound reproduction apparatus 150 may predict a right inflow acoustic signal to be transferred to the audience 110, based on an acoustic signal to be output from the right speaker 154, and determine a right attenuation signal for attenuating or cancelling the predicted right inflow acoustic signal.

In operation 1160, the stereophonic sound reproduction apparatus 150 may output the output acoustic signal generated in operation 1140, through the side speaker 151 and the front speaker 156. The output acoustic signal may include the received acoustic signal generated in operation 1142, of which at least one of a magnitude, a time delay, and an output direction has been controlled, and the attenuation signal generated in operation 1144. The attenuation signal may be output through the front speaker 156.

The above-described stereophonic sound reproduction method may be implemented as computer-readable code on a computer-readable recording medium. The computer-readable recording medium may include any data storage device that can store data that can thereafter be read by a computer system. Examples of the computer-readable recording medium include read-only memories (ROMs), random access memories (RAMs), compact disc read-only memories (CD-ROMs), magnetic tapes, floppy disks, and optical data storage devices, and also include implementation in the form of carrier waves such as transmission through the Internet. In addition, the computer-readable recording medium can also be distributed over network coupled computer systems so that the process-readable code is stored and executed in a distributed fashion.

Methods, processes, apparatuses, products and/or systems according to the present invention are simple, expense-effective, not complex, and very diverse and accurate. In addition, by applying known components to the processes, the apparatuses, the products and the systems according to the present invention, immediately usable, efficient, and economical production, application and utilization can be implemented. Another important aspect of the present invention is to meet a current trend of requiring expense reduction, system simplification, and performance enhancement. As a result, the useful aspects according to the embodiments of the present invention may at least increase a level of the current technology.

While the present invention has been described with reference to exemplary embodiments, the inventions derived by applying replacements, modifications, and updates to the present invention would be obvious to those of ordinary skill in the art in the light of the above description. That is, the claims are analyzed so as to include all the replaced, modified, and updated inventions. Therefore, all the contents described in the specification and the drawings should be analyzed as illustrative and non-restrictive meaning.

The invention claimed is:

1. A stereophonic sound reproduction apparatus comprising:

an input unit configured to receive an acoustic signal;

a control unit configured to acquire an output acoustic signal for generating a virtual sound source for the received acoustic signal; and an output unit configured to output the acquired output acoustic signal by using a front speaker and a side speaker, wherein the control unit is further configured to generate an attenuation signal that is a signal for attenuating or cancelling an inflow acoustic signal to be directly transferred to an audience in the output acoustic signal output from the side speaker, the output acoustic signal output from the front speaker comprises the attenuation signal, and the control unit is further configured to generate the attenuation signal based on at least one of location information between the side speaker and the audience and location information between the front speaker and the audience.

2. The stereophonic sound reproduction apparatus of claim 1, wherein the side speaker comprises a left speaker and a right speaker, the control unit is further configured to generate at least one of a first attenuation signal for attenuating or cancelling, at a location of the audience, a left inflow acoustic signal to be directly transferred to the audience without being reflected from a left wall in an output acoustic signal output from the left speaker and a second attenuation signal for attenuating or cancelling, at the location of the audience, a right inflow acoustic signal to be directly transferred to the audience without being reflected from a right wall in an output acoustic signal output from the right speaker, and the front speaker comprises at least one speaker configured to output at least one attenuation signal of the first attenuation signal and the second attenuation signal.

3. The stereophonic sound reproduction apparatus of claim 2, wherein the control unit is further configured to predict the left inflow acoustic signal and the right inflow acoustic signal arriving at the location of the audience, based on an acoustic transfer function using path information between a location of the side speaker and the location of the audience and generate the attenuation signal based on the predicted left inflow acoustic signal and right inflow acoustic signal, and on an acoustic transfer function using path information between a location of the speaker outputting the attenuation signal and the location of the audience.

4. The stereophonic sound reproduction apparatus of claim 1, wherein the virtual sound source comprises a first virtual sound source for a left channel signal of the received acoustic signal and a second virtual sound source for a right channel signal of the received acoustic signal, and the control unit is further configured to acquire the output acoustic signal by controlling at least one of a magnitude, a time delay, and an output direction of the received acoustic signal, to generate the first virtual sound source and the second virtual sound source based on an acoustic signal generated when the output acoustic signal output from the side speaker is reflected from a wall and on the output acoustic signal output from the front speaker.

5. The stereophonic sound reproduction apparatus of claim 4, wherein the side speaker comprises a left speaker located to the left of the stereophonic sound reproduction apparatus and a right speaker located to the right thereof, and the control unit is further configured to control at least one of a magnitude, a time delay, and an output direction of the received acoustic signal, to generate the first virtual sound source and the second virtual sound source based on an acoustic signal generated when the output acoustic signal output from the left speaker is reflected from a left wall, on an acoustic signal generated when the output acoustic signal output from the right speaker is reflected from a right wall, and on the output acoustic signal output from the front speaker.

6. The stereophonic sound reproduction apparatus of claim 5, wherein the control unit is further configured to control at least one of a magnitude, a time delay, and an output direction of the left channel signal of the received acoustic signal to generate the first virtual sound source at a first location by using an acoustic signal generated when a left channel signal of the output acoustic signal output from the left speaker is reflected from the left wall, an acoustic signal generated when a left channel signal of the output acoustic signal output from the right speaker is reflected from the right wall, and a left channel signal of the output acoustic signal output from the front speaker, and control at least one of a magnitude, a time delay, and an output direction of the right channel signal of the received acoustic signal to generate the second virtual sound source at a second location by using an acoustic signal generated when a right channel signal of the output acoustic signal output from the left speaker is reflected from the left wall, an acoustic signal generated when a right channel signal of the output acoustic signal output from the right speaker is reflected from the right wall, and a right channel signal of the output acoustic signal output from the front speaker, and the first location and the second location are respectively located to the left and the right of the audience based on a direction in which the audience looks at the stereophonic sound reproduction apparatus.

7. The stereophonic sound reproduction apparatus of claim 6, wherein the control unit is further configured to determine the first location and the second location based on spatial characteristics of a sound image provided by the received acoustic signal and control at least one of magnitude values of the left channel signal and the right channel signal of the received acoustic signal based on the determined first location and second location.

8. The stereophonic sound reproduction apparatus of claim 1, wherein the control unit is further configured to determine a distance from the side speaker to a wall and an angle between the side speaker and the wall, and control a direction in which the side speaker outputs an acoustic signal as a horizontal or vertical direction with respect to the ground based on the determined distance and angle.

9. The stereophonic sound reproduction apparatus of claim 1, wherein the side speaker has a horn shape.

10. The stereophonic sound reproduction apparatus of claim 9, wherein the side speaker is included in an enclosure of a woofer inside the stereophonic sound reproduction apparatus.

11. The stereophonic sound reproduction apparatus of claim 1, wherein the control unit comprises a panning unit and an attenuation signal generation unit, the panning unit is configured to control at least one of a magnitude, a time delay, and an output direction of the received acoustic signal to generate the virtual sound source based on the acoustic signal generated when the output acoustic signal output from the side speaker is reflected from the wall and on the output acoustic signal output from the front speaker, and the attenuation signal generation unit is configured to generate the attenuation signal that is a signal for attenuating or cancelling the inflow acoustic signal to be directly transferred to the audience in the output acoustic signal output from the side speaker.

12. A stereophonic sound reproduction method comprising:

receiving an acoustic signal;

acquiring an output acoustic signal for generating a virtual sound source for the received acoustic signal; and outputting the generated output acoustic signal by using a front speaker and a side speaker, wherein the acquiring of the output acoustic signal comprises generating an attenuation signal that is a signal for attenuating or cancelling an inflow acoustic signal to be directly transferred to an audience in the output acoustic signal output from the side speaker, the output acoustic signal output from the front speaker comprises the attenuation signal, and the generating the attenuation signal comprises generating the attenuation signal based on at least one of location information between the side speaker and the audience and location information between the front speaker and the audience.

13. The stereophonic sound reproduction method of claim 12, wherein the side speaker comprises a left speaker and a right speaker, the generating of the output acoustic signal comprises generating at least one of a first attenuation signal for attenuating or cancelling, at a location of the audience, a left inflow acoustic signal to be directly transferred to the audience without being reflected from a left wall in an output acoustic signal output from the left speaker, and a second attenuation signal for attenuating or cancelling, at the location of the audience, a right inflow acoustic signal to be directly transferred to the audience without being reflected from a right wall in an output acoustic signal output from the right speaker, and the front speaker comprises at least one speaker configured to output at least one attenuation signal of the first attenuation signal and the second attenuation signal.

14. The stereophonic sound reproduction method of claim 12, wherein the virtual sound source comprises a first virtual sound source for a left channel signal of the received acoustic signal and a second virtual sound source for a right channel signal of the received acoustic signal, the generating of the output acoustic signal comprises controlling at least one of a magnitude, a time delay, and an output direction of the received acoustic signal, to generate the first virtual sound source and the second virtual sound source based on an acoustic signal generated when the output acoustic signal output from the side speaker is reflected from a wall and on the output acoustic signal output from the front speaker, and the generated output acoustic signal comprises the controlled acoustic signal.

15. A computer-readable recording medium having recorded thereon a program for executing, in a computer, the method of claim 12.

* * * * *